US010449799B2

(12) United States Patent
Yamahiro et al.

(10) Patent No.: US 10,449,799 B2
(45) Date of Patent: Oct. 22, 2019

(54) ATTACHMENT DEVICE AND ATTACHMENT METHOD

(71) Applicant: HONDA MOTOR CO., LTD., Minato-ku, Tokyo (JP)

(72) Inventors: Takuji Yamahiro, Tochigi-ken (JP); Natsuki Mamiya, Tochigi-ken (JP); Masaru Yoshimoto, Tochigi-ken (JP); Yasuhiro Funato, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/760,247

(22) PCT Filed: Sep. 15, 2016

(86) PCT No.: PCT/JP2016/077319
§ 371 (c)(1),
(2) Date: Mar. 15, 2018

(87) PCT Pub. No.: WO2017/047711
PCT Pub. Date: Mar. 23, 2017

(65) Prior Publication Data

US 2018/0264872 A1 Sep. 20, 2018

(30) Foreign Application Priority Data

Sep. 18, 2015 (JP) ..... 2015-184821
Sep. 18, 2015 (JP) ..... 2015-184822
Sep. 18, 2015 (JP) ..... 2015-184825

(51) Int. Cl.
*B44C 1/17* (2006.01)
*B44C 1/10* (2006.01)
(Continued)

(52) U.S. Cl.
CPC ..... *B44C 1/1745* (2013.01); *B41F 16/008* (2013.01); *B41F 16/0053* (2013.01);
(Continued)

(58) Field of Classification Search
USPC ..... 156/156, 230, 240, 247, 249, 289, 537, 156/540, 541, 542
See application file for complete search history.

(56) References Cited

U.S. PATENT DOCUMENTS 3,554,834 A * 1/1971 Orwin ..... B28B 11/001 156/230
3,757,735 A * 9/1973 Crowe ..... B05C 9/08 118/50
(Continued)

FOREIGN PATENT DOCUMENTS

CN 102152590 8/2011
JP 04332644 A * 11/1992
(Continued)

OTHER PUBLICATIONS

English Abstract of JP 04-332644A (Year: 2019).*
(Continued)

*Primary Examiner* — Sing P Chan
(74) *Attorney, Agent, or Firm* — Amin, Turocy & Watson LLP

(57) ABSTRACT

In an attachment device, the atmospheric pressure of a lower space which is formed by a container and an attachment film and the atmospheric pressure of an upper space which is formed by a lid and the attachment film are varied to cause elastic deformation of the attachment film, so that a decorative sheet is attached to a cowl. Disposed inside the container are: a jig that puts the cowl in place; and a restriction plate which is disposed at a location close to the cowl so as to cause at least a part of the cowl to be exposed
(Continued)

to the attachment film side, and which has a reception surface that restricts the elastic deformation of the attachment film. In addition, the reception surface is provided with a small through-hole that allows the air inside the lower space to flow therethrough.

19 Claims, 11 Drawing Sheets

(51) Int. Cl.
*B44C 5/00* (2006.01)
*B41F 16/00* (2006.01)
*B65C 9/28* (2006.01)

(52) U.S. Cl.
CPC ..... *B44C 1/10* (2013.01); *B44C 5/00* (2013.01); *B65C 9/28* (2013.01)

(56) References Cited

U.S. PATENT DOCUMENTS 3,960,633 A * 6/1976 Gossie ..... B28B 11/001 156/247
4,026,755 A * 5/1977 Gossie ..... B28B 11/001 156/285
4,052,241 A * 10/1977 Walter ..... B29C 51/16 156/245
4,094,716 A * 6/1978 Lopez ..... B44C 1/1756 101/126
4,152,188 A * 5/1979 Friedrich ..... B32B 17/10844 100/211
4,283,242 A * 8/1981 Regler ..... B24B 37/27 156/154
5,772,950 A * 6/1998 Brustad ..... B29C 53/025 156/222
5,814,173 A * 9/1998 Stone ..... B29C 65/48 156/249
8,066,929 B2 * 11/2011 Eberth ..... B29C 31/008 264/293
8,333,864 B2 * 12/2012 Brennan ..... B29C 70/44 156/285
8,371,838 B2 * 2/2013 Eberth ..... B29C 31/008 264/293
8,505,361 B2 * 8/2013 Miller ..... G01M 3/227 73/49.3
8,613,301 B2 * 12/2013 Brennan ..... B29C 70/44 156/285
8,707,766 B2 * 4/2014 Harris ..... G01N 21/78 264/571
8,936,695 B2 * 1/2015 Rotter ..... B29C 70/382 156/285
9,046,437 B2 * 6/2015 Miller ..... G01M 3/227
9,144,959 B1 * 9/2015 Rotter ..... B29C 66/81455
9,370,922 B1 * 6/2016 Metschan ..... B29C 70/543
9,500,593 B2 * 11/2016 Harris ..... G01N 21/78
9,511,548 B1 * 12/2016 Rotter ..... B29C 70/44
9,757,929 B2 * 9/2017 Niebling ..... B29C 63/16
10,035,373 B2 * 7/2018 Yoshimoto ..... B44C 3/048
10,076,884 B2 * 9/2018 Duclos ..... B29C 43/34
10,105,911 B2 * 10/2018 Duclos ..... B29C 43/34
2011/0206884 A1 8/2011 Nakamura et al.
2015/0352822 A1 * 12/2015 Niebling ..... B29C 63/16 156/237
2016/0144656 A1 * 5/2016 Yoshimoto ..... B44C 3/048 428/99
2017/0182513 A1 * 6/2017 Cassoni ..... B05D 1/28
2017/0182704 A1 * 6/2017 Allen ..... B29C 65/48
2017/0182705 A1 * 6/2017 Allen ..... B65C 1/021
2017/0182756 A1 * 6/2017 Cassoni ..... B32B 37/025
2017/0183124 A1 * 6/2017 Allen ..... B32B 37/025
2018/0264872 A1 * 9/2018 Yamahiro ..... B44C 5/00
2018/0272682 A1 * 9/2018 Allen ..... B32B 37/025
2018/0354249 A1 * 12/2018 Martinez de Leon ..... B32B 37/025
2018/0354253 A1 * 12/2018 Sawin ..... B41F 16/002
2019/0153248 A1 * 5/2019 Martinez de Leon ..... B29C 65/4845

FOREIGN PATENT DOCUMENTS

JP 5249182 6/2011
WO 2011/071091 6/2011

OTHER PUBLICATIONS

International Search Report and Written Opinion for International Patent Application No. PCT/JP2016/077319 dated Nov. 15, 2016, 9 pages.
Chinese Office Action and Search Report for Chinese Patent Application No. 201680054317.0 dated Jul. 30, 2019.

* cited by examiner

10
CONTROLLER
16
32
40
22
W
14
84 (74)
86
84b
85
24
84a
68a
122
111
110
100
X2
X
X1
58
20
120, 122
112
114
116
108
12
92g (92)
92d
54
56
94
92c (92)
36
60
44
18
92h (92)
30
98
128
98b
134
96
W
36
40
38
34
Y1
Y
Y2

ATTACHMENT DEVICE AND ATTACHMENT METHOD

TECHNICAL FIELD

The present invention relates to a sticking apparatus (attachment device) and a sticking method (attachment method) for sticking a decorative material on an object.

BACKGROUND ART

A decorative material (for example, a decorative sheet of a logo or the like) is stuck on a vehicle body (an object) of a vehicle for the purpose of improvement of the appearance or indication of necessary information. In Japanese Patent No. 5249182, a sticking apparatus that sticks such a decorative material is disclosed. This sticking apparatus includes a container that houses an object, a lid body that is attached to the container, and a sticking film that is placed between the container and the lid body. In the sticking apparatus, a pressure in a first space defined by the container and the sticking film and a pressure in a second space defined by the lid body and the sticking film are changed to thereby elastically deform the sticking film toward the first space, whereby a decorative material, which is attached to the sticking film, is stuck on the object.

SUMMARY OF INVENTION

This type of sticking apparatus uses a pressure difference between the first space and the second space to elastically deform the sticking film, and thereby strongly pull or draw the sticking film. As a result, the sticking film is greatly stretched each time a decorative material is stuck on an object.

Moreover, in the sticking apparatus disclosed in Japanese Patent No. 5249182, a suction mechanism (a pressure-reducing pump) that suctions air in the first space and another suction mechanism that suctions air in the second space are separately provided in a pressure-reducing mechanism and the suction mechanisms are independently controlled.

Furthermore, in this type of sticking apparatus, before attachment of the container and the lid body, an operation to stick (attach) the decorative material temporarily on the sticking film is performed. If various components such as the container, the lid body, a lifting/lowering mechanism, and the pressure-reducing mechanism, etc., of the sticking apparatus are present around the sticking film at the time of this operation, such an operation is burdensome, or the possibility of sticking the decorative material on the sticking film at a wrong position is increased. This consequently results in poor sticking of the decorative material on the object and a reduction in operation efficiency.

The present invention has been made in relation to the above-described technique of sticking a decorative material on an object, and has the object of providing a sticking apparatus and a sticking method which can stick a decorative material on an object more satisfactorily.

To attain the above-described object, according to the present invention, there is provided a sticking apparatus configured to stick a decorative material, which is attached to a sticking film, on an object housed in a container by changing a pressure inside a first space defined by the container and the sticking film and a pressure inside a second space defined by a lid body and the sticking film and thereby elastically deforming the sticking film. The container contains therein a jig configured to position the object, and a restricting section disposed in a location that is close to or in contact with the object positioned by the jig, the restricting section having a receiving surface configured to restrict elastic deformation of the sticking film by making contact with the sticking film, wherein at least part of the object is exposed so as to face the sticking film through the receiving surface, and the receiving surface is provided with a hole portion configured to allow air in the first space to flow therethrough.

According to the above configuration, by placing the restricting section in a location that is close to or in contact with the object positioned in the container, the receiving surface receives the sticking film when the sticking film is elastically deformed toward the first space, and thus it is possible to restrict great stretch of the sticking film around the object. Therefore, performance degradation of the sticking film caused by elastic deformation is suppressed, and the sticking apparatus can use the sticking film in the sticking operation for a longer period of time, which makes it possible to reduce the production cost significantly. Moreover, since the restricting section has the hole portion, it is possible to easily flow air in the container when the first space is depressurized. Thus, it is possible to depressurize the first space evenly, and thereby stick the decorative material on the object with stability and a high degree of accuracy when the sticking film is elastically deformed.

In this case, preferably the receiving surface is formed so as to be in parallel to the direction of a surface of the sticking film in a normal state in which the sticking film is not elastically deformed.

As described above, since the receiving surface is in parallel to the direction of a surface of the sticking film, the sticking film makes contact with the receiving surface over a wider area when the sticking film is elastically deformed, and thus it is possible to restrict the elastic deformation of the sticking film. Thus, performance degradation of the sticking film can be further suppressed.

Moreover, the receiving surface may be placed above an intermediate part of the container in a height direction thereof.

As described above, since the receiving surface is placed above the intermediate part of the container in the height direction thereof, the amount of stretch of the sticking film can be further reduced when the sticking film is elastically deformed.

Furthermore, the restricting section preferably includes, near a peripheral part of the container, a shock-absorbing section protruding toward the sticking film from the receiving surface, and the sticking film is contactable with the shock-absorbing section.

As described above, since the sticking apparatus includes the shock-absorbing section on a peripheral part of the container, it is also possible to effectively suppress stretch of a peripheral part of the sticking film.

Moreover, to attain the above-described object, according to the present invention, there is provided a sticking apparatus configured to stick a decorative material, which is attached to a sticking film, on an object housed in a container by changing a pressure inside a first space defined by the container and the sticking film and a pressure inside a second space defined by a lid body and the sticking film and thereby elastically deforming the sticking film. The sticking apparatus includes: a gas flow circuit that includes a first flow channel communicating with the first space, a second flow channel communicating with the second space, and a converging flow channel into which the first and second flow channels converge; a suction mechanism connected to the converging flow channel and configured to suction gas from the gas flow circuit; a first measuring unit configured to measure the pressure inside the first space; a second measuring unit configured to measure the pressure inside the second space; and a flow rate regulating unit provided in the second flow channel and configured to regulate the flow rate of the gas in the second flow channel based on the measured pressure inside the first space and the measured pressure inside the second space.

According to the above feature, the sticking apparatus can suction gas concurrently from the first space and the second space by the suction mechanism connected to the converging flow channel of the gas flow circuit. At this time, the flow rate regulating unit regulates the flow rate of the gas in the second flow channel, whereby the first space and the second space, which have different volumes, are depressurized while maintaining equal pressures in the first and second spaces. As a result, the elastic deformation of the sticking film caused by a pressure difference between the first and second spaces is suppressed, and when subsequently the sticking film is elastically deformed by introducing gas into the first space, it is possible to stick the decorative material on the object satisfactorily. In addition, since the sticking apparatus uses one suction mechanism for suctioning air from both the container and the lid body, the apparatus itself is made inexpensive and the production cost can be reduced.

In this case, the sticking apparatus may include a plurality of sticking stations, each including the container, and the first flow channel may branch off and is connected to each of the containers of the plurality of sticking stations, the first flow channel being configured to selectively communicate with one of the containers.

As described above, since the sticking apparatus is provided with a plurality of sticking stations, it is possible to efficiently perform a sticking operation to stick the decorative material on the object. In addition, since the first flow channel branches off and is connected to the plurality of containers, it is possible to selectively depressurize the plurality of containers by one suction mechanism.

Furthermore, the plurality of sticking stations may share the lid body, the second flow channel may include a coupling mechanism at an intermediate position between the flow rate regulating unit and the second space, and the coupling mechanism may include a movable-side terminal configured to move integrally with the lid body, and a fixed-side terminal provided on each of the plurality of sticking stations and configured to be detachably coupled to the movable-side terminal so that the second flow channel is placed in a communication state.

As described above, in the sticking apparatus, since the lid body is shared, the cost of the apparatus is reduced and the cost of the sticking operation can be significantly reduced. Moreover, even when the sticking apparatus is made up with the plurality of sticking stations, the coupling mechanism makes it possible to easily perform suction of gas via the gas flow circuit.

Furthermore, to attain the above-described object, according to the present invention, there is provided a sticking apparatus configured to stick a decorative material on an object, and the sticking apparatus includes: a first sticking unit configured to place a sticking tool having a sticking film and stick the decorative material on the sticking film in a state in which a sticking surface of the decorative material is exposed; and a second sticking unit provided in a location different from the location of the first sticking unit, and including a container configured to house the object and a lid body configured to be detachably attached to the container with the sticking film, on which the decorative material was stuck in the first sticking unit, being sandwiched between the container and the lid body, the second sticking unit being configured to stick the decorative material on the object by changing a pressure inside a first space defined by the container and the sticking film and a pressure inside a second space defined by the lid body and the sticking film and thereby elastically deforming the sticking film.

According to the above configuration, in the sticking apparatus, the first sticking unit for sticking the decorative material on the sticking film and the second sticking unit for sticking the decorative material, which is stuck on the sticking film, on the object are arranged in different locations. As a result, the first sticking unit performs only an operation to stick the decorative material on the sticking film, and thus it is possible to stick the decorative material on the sticking film quickly and accurately. That is, with a simple configuration in which a first sticking step and a second sticking step are performed in different locations, the accuracy of sticking the decorative material on the object and the operation efficiency are improved, and the mass-production efficiency thereof can be further improved.

In this case, the sticking apparatus preferably includes a plurality of sticking stations, each including the first sticking unit and the second sticking unit excluding the lid body, and the lid body is shared by the plurality of sticking stations.

The sticking apparatus can perform the sticking operation more efficiently by using the plurality of sticking stations, each including the first sticking unit and the second sticking unit. Moreover, since the lid body is shared by the plurality of sticking stations, the cost of the apparatus is reduced and the cost of the sticking operation can be significantly reduced.

In addition to the above-described configuration, the sticking apparatus may include a suction mechanism configured to impart a suction force to the first space and the second space, and the suction mechanism may be shared by the plurality of sticking stations.

As described above, in the sticking apparatus, since the suction mechanism is shared by the plurality of sticking stations, the operation rate of the suction mechanism is increased, and the cost of the apparatus is reduced.

It is preferable that, in two sticking stations of the plurality of sticking stations, the second sticking units should be adjacent to each other and the lid body should be moved between the second sticking units of the two sticking stations by a lid body driving unit.

As described above, in the sticking apparatus, since the second sticking units of the two sticking stations are adjacent to each other, the distance by which the lid body is moved by the lid body driving unit is shortened, and thus it is possible to reduce workload of the apparatus for performing the sticking operation and also reduce an operation space.

Moreover, when the first sticking unit in one of the two sticking stations performs an operation to stick the decorative material on the sticking film, the second sticking unit in the other one of the two sticking stations may perform an operation to stick the decorative material on the object, and when the second sticking unit in the one of the two sticking stations performs an operation to stick the decorative material on the object, the first sticking unit in the other one of the two sticking stations may perform an operation to stick the decorative material on the sticking film.

As described above, by making the operations of the sticking unit and the second sticking unit of the two sticking stations different from each other, it is possible to perform the sticking operation in alternate shifts and thereby further improve mass-production efficiency.

Furthermore, to attain the above-described object, according to the present invention, there is provided a sticking method of sticking a decorative material, which is attached to a sticking film, on an object housed in a container by changing a pressure inside a first space defined by the container and the sticking film and a pressure inside a second space defined by a lid body and the sticking film and thereby elastically deforming the sticking film. The sticking method includes: a first step of positioning the object on a jig provided in the container and exposing at least part of the object through a receiving surface of a restricting section so as to face the sticking film , the restricting section being disposed in a location that is close to or in contact with the object; a second step of, after the first step, depressurizing the first and second spaces, and at this time, causing air in the first space to flow through a hole portion formed in the receiving surface; and a third step of, after the second step, sticking the decorative material on the object by introducing air into the second space to thereby elastically deforming the sticking film toward the object, while causing air to flow through the hole portion from a side of the first space closer to the sticking film toward another side thereof across the receiving surface from the sticking film, and restricting elastic deformation of the sticking film around the object by the receiving surface.

In addition, to attain the above-described object, according to the present invention, there is provided a sticking method of sticking a decorative material, which is attached to a sticking film, on an object housed in a container by changing a pressure inside a first space defined by the container and the sticking film and a pressure inside a second space defined by a lid body and the sticking film and thereby elastically deforming the sticking film. The sticking method includes the steps of: suctioning gas in a gas flow circuit by a suction mechanism, the gas flow circuit including a first flow channel communicating with the first space, a second flow channel communicating with the second space, and a converging flow channel into which the first and second flow channels converge, the suction mechanism being connected to the converging flow channel; measuring the pressure inside the first space by a first measuring unit; measuring the pressure inside the second space by a second measuring unit; and regulating a flow rate of the gas by a flow rate regulating unit provided in the second flow channel based on the measured pressure inside the first space and the measured pressure inside the second space.

Furthermore, to attain the above-described object, according to the present invention, there is provided a sticking method of a sticking apparatus configured to stick a decorative material on an object, and the sticking method includes: a first sticking step of placing a sticking tool having a sticking film in a first sticking unit and sticking the decorative material on the sticking film in a state in which a sticking surface of the decorative material is exposed; and a second sticking step of sticking the decorative material on the object by changing a pressure inside a first space defined by a container and the sticking film and a pressure inside a second space defined by a lid body and the sticking film to thereby elastically deform the sticking film in a second sticking unit provided in a location different from the location of the first sticking unit, the second sticking unit including the container configured to house the object, and the lid body configured to be detachably attached to the container with the sticking film, on which the decorative material was stuck in the first sticking step, being sandwiched between the container and the lid body.

In this case, the sticking apparatus may include a plurality of sticking stations configured to perform the first sticking step and the second sticking step, and, in the second sticking step, the plurality of sticking stations may share the lid body.

In addition to the above-described configuration, the sticking apparatus may include a suction mechanism configured to impart a suction force to the first space and the second space, and in the second sticking step, the plurality of sticking stations may share the suction mechanism.

In two sticking stations of the plurality of sticking stations, the second sticking units may be adjacent to each other, and before the second sticking step is performed, a movement step of moving the lid body between the second sticking units of the two sticking stations by a lid body driving unit may be performed.

Moreover, when one of the two sticking stations performs the first sticking step, the other one of the two sticking stations may perform the second sticking step, and when the one of the two sticking stations performs the second sticking step, the other one of the two sticking stations may perform the first sticking step.

With the sticking apparatus and the sticking method according to the present invention, it is possible to stick the decorative material on the object more suitably.

DESCRIPTION OF EMBODIMENTS

Hereinafter, a preferred embodiment of a sticking apparatus according to the present invention will be described in detail with reference to the attached drawings in connection with a sticking method.

A sticking apparatus 10 according to the present embodiment is provided in a vehicle production process and performs a sticking operation to stick a decorative sheet S (a decorative material) on a cowl C (an object: a material to be decorated). The decorative material which is stuck by the sticking apparatus 10 is not limited to a sheet-shaped decorative material, and it is possible to select any decorative material as long as it can be stuck on the object. Moreover, the object is also not limited to the cowl C, and the object may have various shapes.

Figure 1:
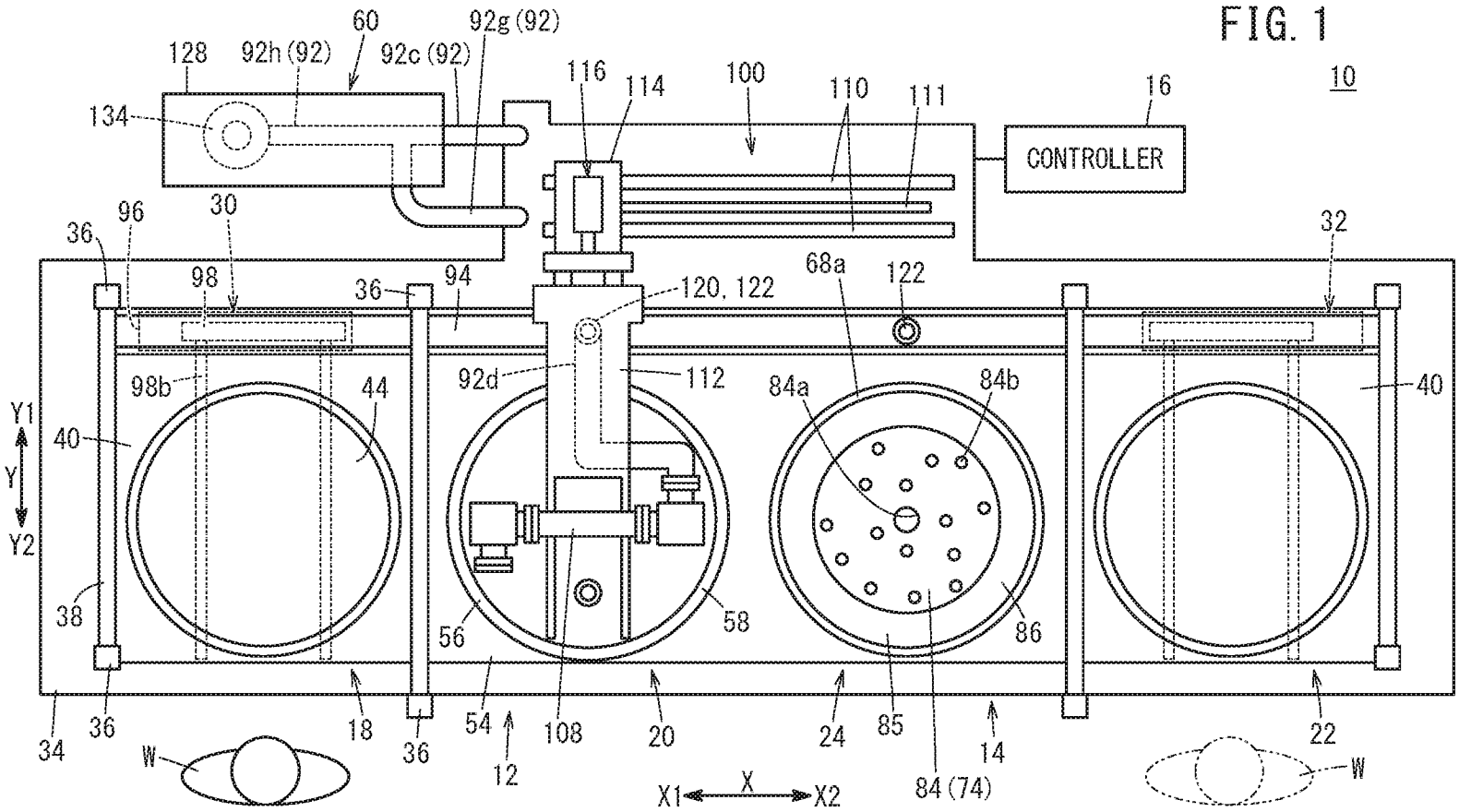
FIG. 1 is a plan view schematically depicting the general configuration of a sticking apparatus according to an embodiment of the present invention.
Figure 2:
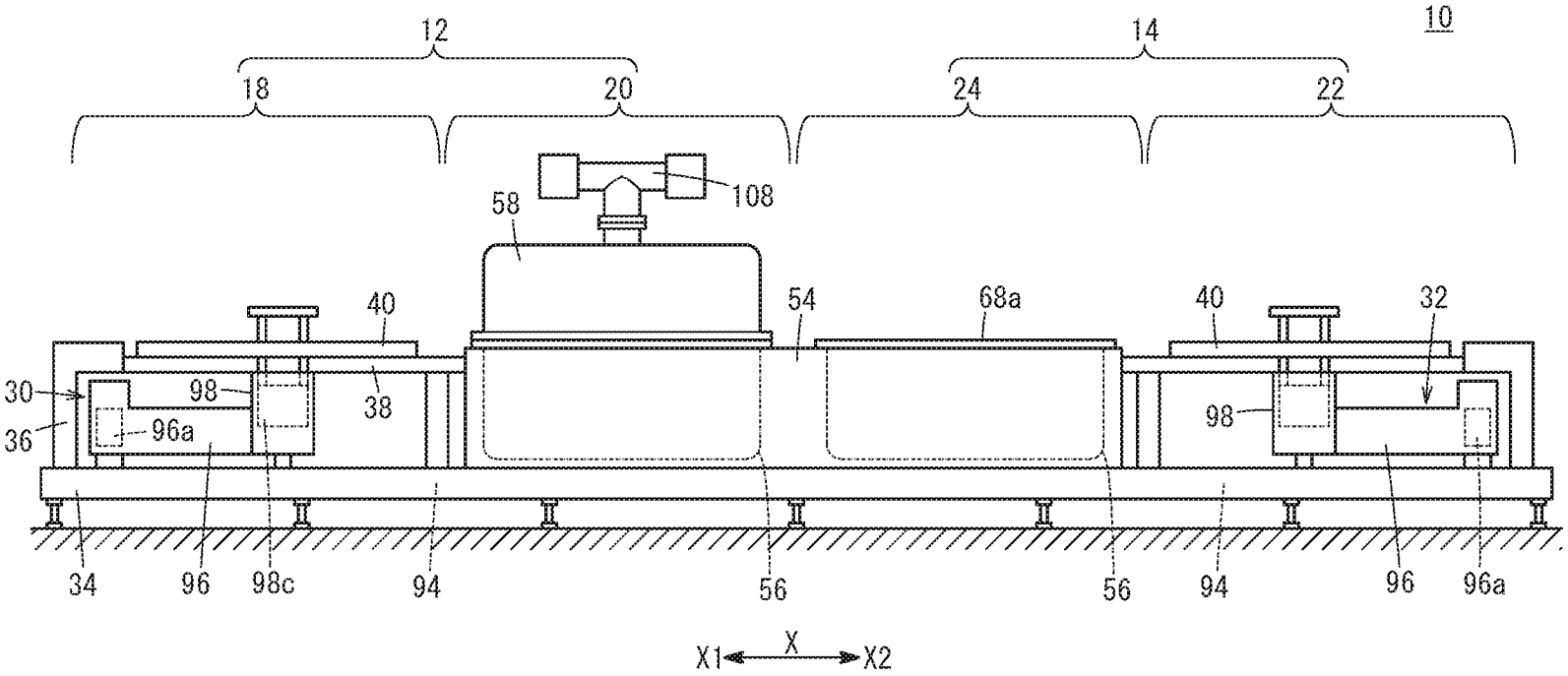
FIG. 2 is a front view schematically depicting the sticking apparatus of FIG. 1.

As depicted in FIGS. 1 and 2, the sticking apparatus 10 includes two sticking stations (a first sticking station 12 and a second sticking station 14) which are adjacent to each other and a controller 16 that controls the overall operation of the apparatus. The first and second sticking stations 12 and 14 perform sticking in their respective installation locations under control of the controller 16.

The first sticking station 12 includes a first temporary sticking unit 18 and a first main sticking unit 20, and the second sticking station 14 includes a second temporary sticking unit 22 and a second main sticking unit 24. The first and second temporary sticking units 18 and 22 (a first sticking unit) have an operation area for a temporary sticking operation for sticking the decorative sheet S (see FIG. 4) temporarily on a sticking film 28 (see FIG. 3) of the sticking apparatus 10, and a mechanism section that mechanically performs the temporary sticking operation. The first and second main sticking units 20 and 24 (a second sticking unit) have an operation area for a main sticking operation for sticking the decorative sheet S, which is stuck on the sticking film 28, on the cowl C (see FIG. 4), and a mechanism section that mechanically performs a main sticking operation.

Moreover, the first sticking station 12 includes a first conveying unit 30 that moves a sticking tool 26 (see FIG. 3) with the sticking film 28, between the first temporary sticking unit 18 and the first main sticking unit 20. Likewise, the second sticking station 14 also includes a second conveying unit 32 that moves the sticking tool 26 with the sticking film 28, between the second temporary sticking unit 22 and the second main sticking unit 24.

The first sticking station 12 and the second sticking station 14 are installed so as to be symmetric with respect to the center of the sticking apparatus 10 in an arrow X direction depicted in FIG. 1. That is, the sticking apparatus 10 is configured with the first temporary sticking unit 18, the first main sticking unit 20, the second main sticking unit 24, and the second temporary sticking unit 22 which are arranged in this order from X1 to X2 in FIG. 1. These units are fixed to a base 34 extending in the arrow X direction and partitioned with unillustrated installation frames. Hereinafter, it is assumed that, when the detailed configurations of the first and second sticking stations 12 and 14 are explained, unless otherwise specified, the configuration of the first sticking station 12 will be described as a representative configuration.

The first temporary sticking unit 18 has an operation space in the form of a solid lattice, which is defined by four vertical frames 36 that stand upright from the base 34 and horizontal frames 38 that form bridges between the four vertical frames 36 at a predetermined height position. In addition, the first temporary sticking unit 18 has a substantially square shape when viewed in a plan view (see FIG. 1) and includes a box-shaped placement section 40 supported by the horizontal frames 38.

Figure 3:
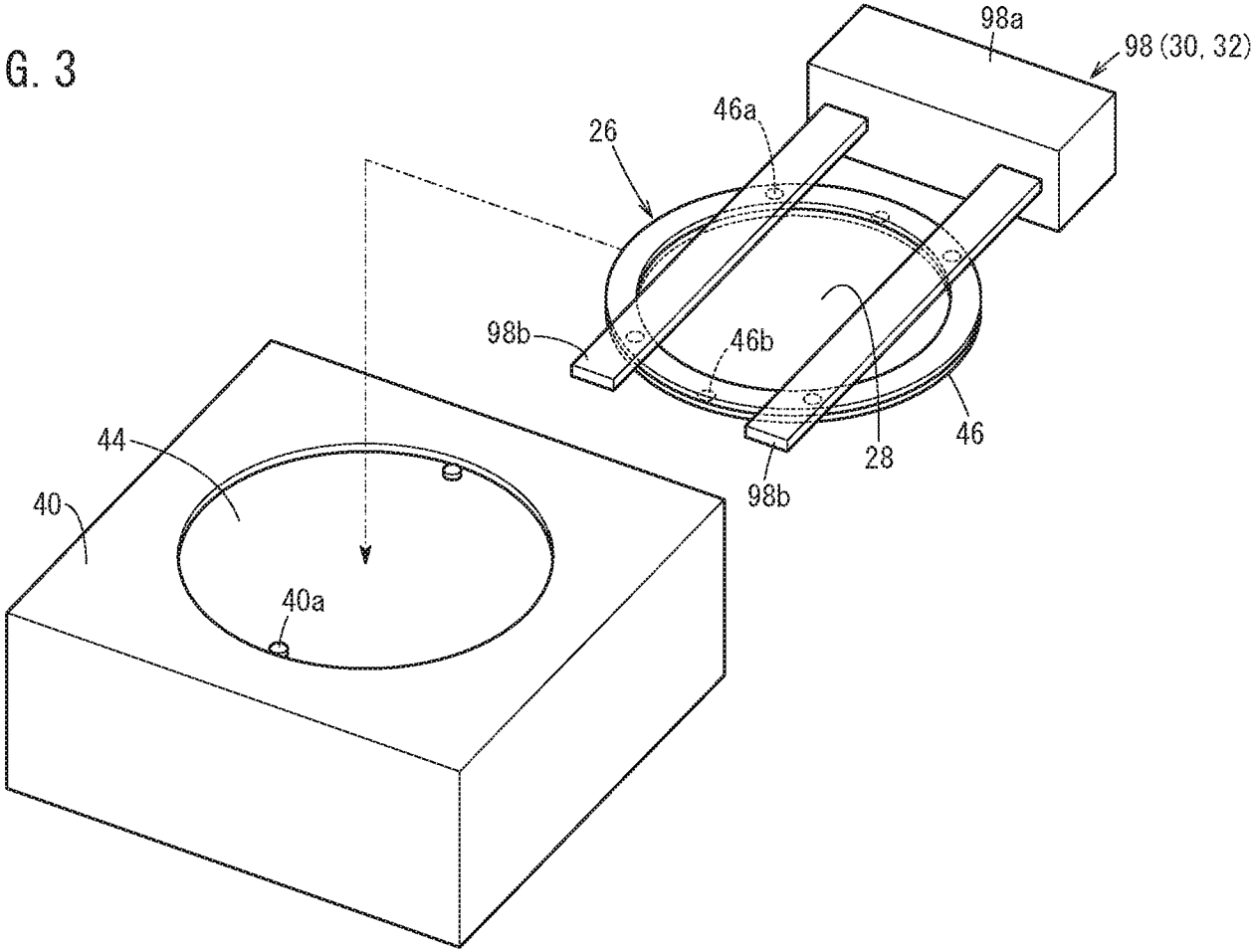
FIG. 3 is an explanatory diagram depicting a first temporary sticking unit and a sticking tool of the sticking apparatus of FIG. 1.

The placement section 40 has a disk-shaped body 44 in the form of a circle when viewed in a plan view, and the decorative sheet S is placed on this disk-shaped body 44 by a worker W. As depicted in FIG. 3, the disk-shaped body 44 is slightly depressed so as to receive the sticking tool 26 (a holding frame 46) therein, and, at predetermined positions on the peripheral edge of the disk-shaped body 44, a plurality of positioning protrusions 40*a* for positioning the sticking tool 26 are provided. The positioning protrusions 40*a* and the peripheral edge of the disk-shaped body 44 function as an electromagnet by being energized by an unillustrated power supply in the placement section 40. Moreover, surface treatment is performed on the upper surface of the disk-shaped body 44 so that a sticking surface Sa of the decorative sheet S does not stick thereon or does not easily stick thereon even when the sticking surface Sa of the decorative sheet S is put thereon. It is preferable to appropriately use, as the material for the disk-shaped body 44, a material on which the decorative sheet S does not easily stick, and examples thereof include resin materials such as a silicone rubber. Furthermore, the placement section 40 is provided with an unillustrated placement and fixing mechanism for fixing the sticking tool 26, an unillustrated detecting section for detecting placement of the sticking tool 26, and so forth.

When the first temporary sticking unit 18 is to be operated, after the decorative sheet S is placed in a proper position by the worker W, the sticking tool 26 is placed by the first conveying unit 30. The sticking tool 26 has the above-described sticking film 28 in the form of a thin film and the holding frame 46 for fixing and holding the sticking film 28.

The sticking film 28 has a circular shape having substantially the same size as that of the disk-shaped body 44 when viewed in a plan view, and can be elastically deformed in a direction orthogonal to a direction along a surface thereof. The lower surface of the sticking film 28, which faces the disk-shaped body 44, is formed such that a decorative surface Sb (see FIG. 4) of the decorative sheet S can stick to the lower surface. The material for the sticking film 28 is not limited to a particular material; for example, various rubber materials such as natural rubber, isoprene rubber, butyl rubber, and silicone rubber or elastomer-based resin materials can be used.

Meanwhile, the holding frame 46 of the sticking tool 26 is formed into an annular shape when viewed in a plan view, and sandwiches the entire peripheral edge of the sticking film 28 in a thickness direction. The holding frame 46 maintains the sticking film 28 in a stretched state in a normal state in which no external force is applied to the sticking tool 26. Upon application of an external force, the holding frame 46 allows an inner portion of the sticking film 28 to stretch in the direction orthogonal to the direction along a surface thereof.

Moreover, a plurality of upper-side positioning holes 46*a* are formed at predetermined positions on the upper surface of the holding frame 46, and positioning pins (not shown) of the first conveying unit 30, which will be described later, are inserted into the upper-side positioning holes 46*a*. Furthermore, a plurality of lower-side positioning holes 46*b*, into which the positioning protrusions 40*a* of the placement section 40 are inserted, are formed at the lower surface of the holding frame 46.

When the above-described sticking tool 26 is positioned in the placement section 40, the lower surface of the sticking film 28 and the upper surface of the disk-shaped body 44 are disposed face-to-face with each other. As a result, the decorative sheet S put on the upper surface of the disk-shaped body 44 overlaps with a proper position on the lower surface of the sticking film 28. When the sticking tool 26 is placed in the placement section 40, the decorative sheet S is stuck on (attached to) the lower surface of the sticking film 28. To facilitate sticking of the decorative sheet S on the sticking film 28, the worker W may press the sticking film 28 from above after placement of the sticking tool 26.

After sticking the decorative sheet S on the sticking film 28 by the first temporary sticking unit 18, the sticking apparatus 10 moves the sticking tool 26 to the adjacent first main sticking unit 20 by the first conveying unit 30 and performs a main sticking operation to stick, on the cowl C, the decorative sheet S attached to the sticking film 28. As depicted in FIG. 1, the first main sticking unit 20 includes a housing 54 that is provided on the base 34, and a container 56 that is fixed in the housing 54. Moreover, the first and second main sticking units 20 and 24 include one lid body 58 that can be attached to each container 56, and an air supply and discharge mechanism section 60 for changing a pressure in the container 56 and a pressure in the lid body 58.

Figure 4:
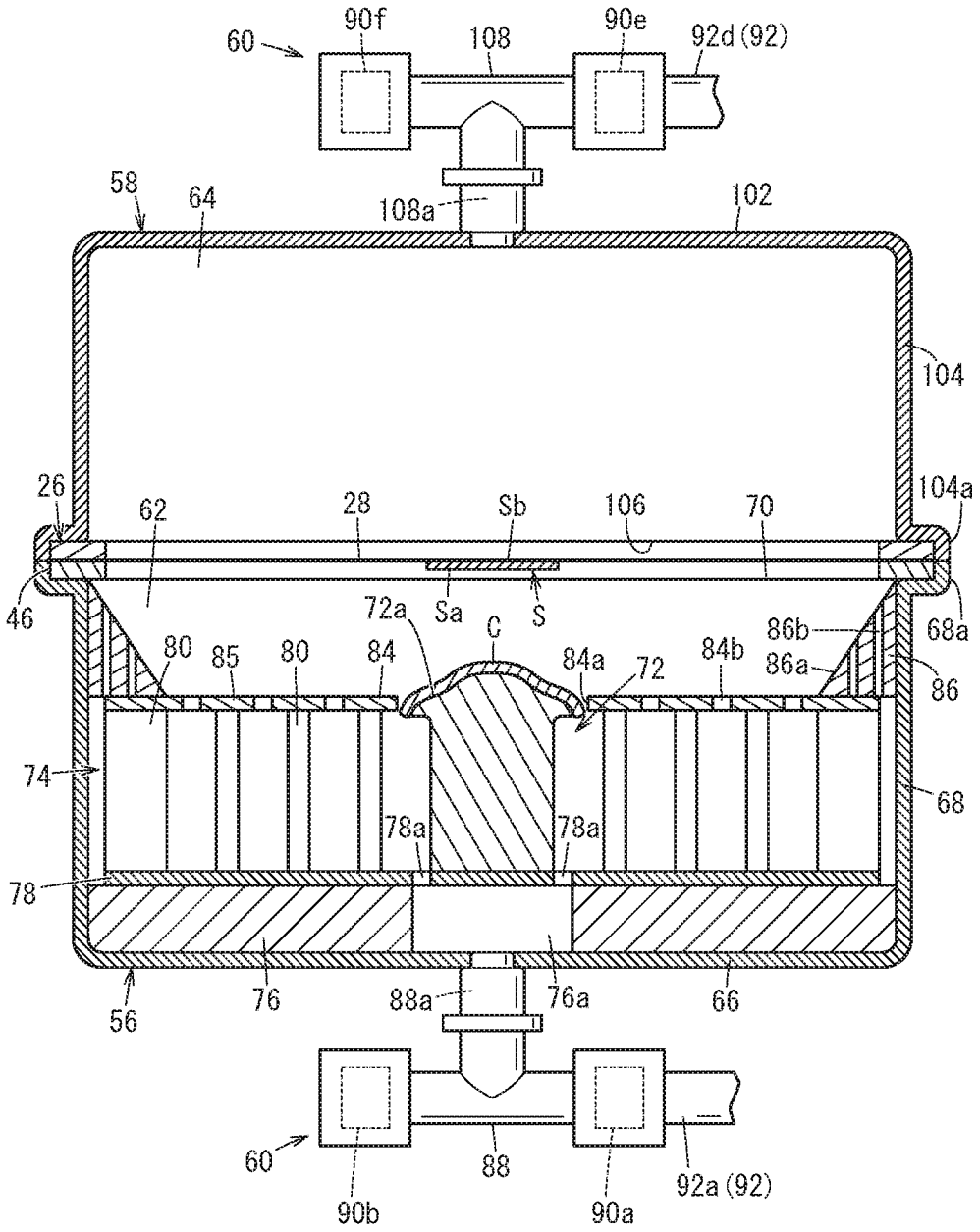
FIG. 4 is a side sectional view depicting an attachment state of a container and a lid body of the sticking apparatus of FIG. 1.

To facilitate understanding of the invention, a schematic description of an operation at the time of the main sticking operation will be given first. In the main sticking operation, as depicted in FIG. 4, the cowl C is placed in the container 56, the sticking tool 26 is placed on the container 56, and the lid body 58 is attached to the container 56 and the sticking tool 26. By doing so, the internal spaces of the container 56 and the lid body 58 are closed. In this state, a lower space 62 (a first space) defined by the container 56 and the sticking film 28 is hermetically sealed in an airtight manner, and an upper space 64 (a second space) defined by the lid body 58 and the sticking film 28 is hermetically sealed in an airtight manner. Moreover, the decorative sheet S stuck on the sticking film 28 is placed in a state in which the sticking surface Sa is exposed above the cowl C.

Figure 9:
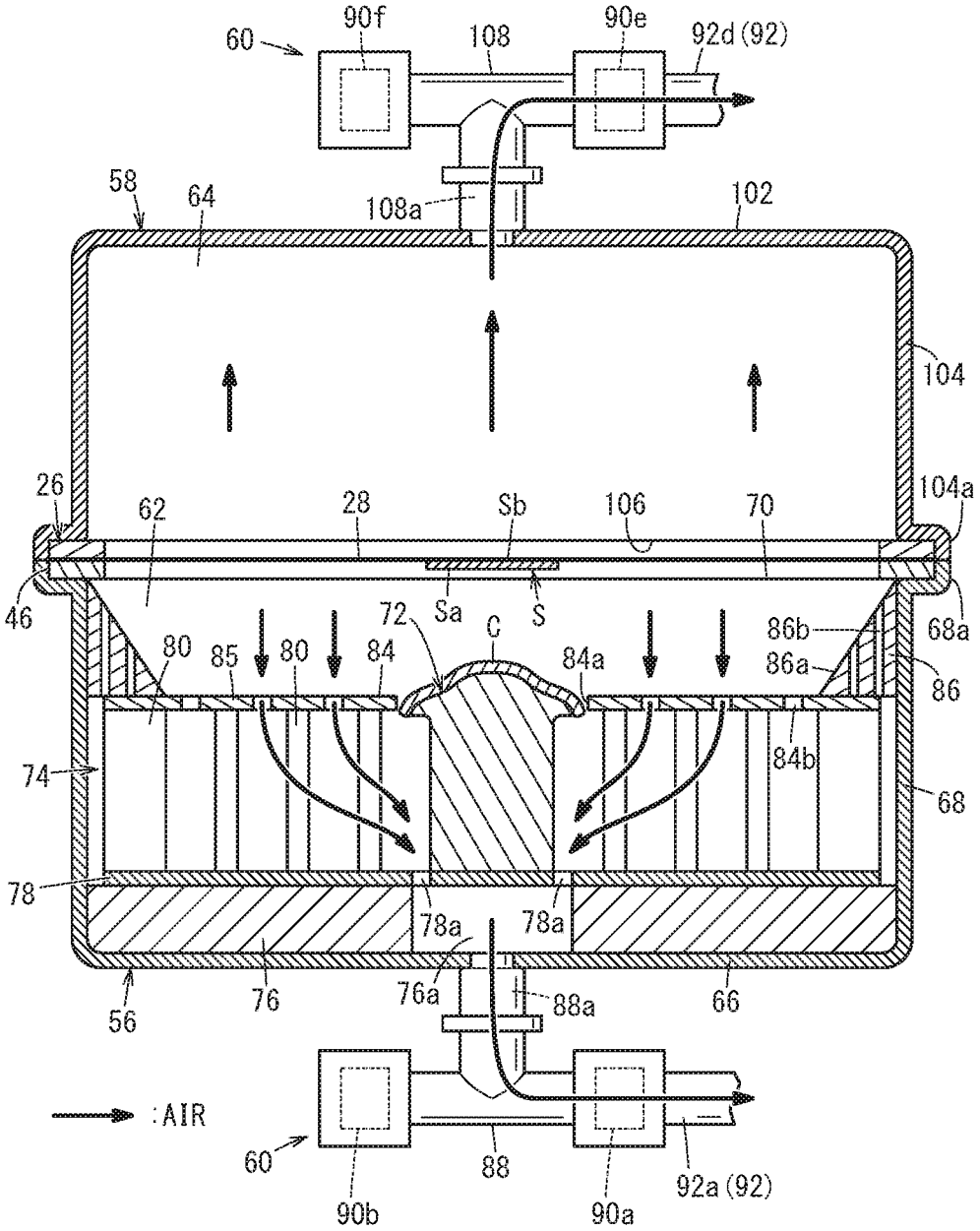
FIG. 9 is a second side sectional view that explains the operation of the sticking apparatus at the time of main sticking.

Then, the pressure inside the lower space 62 and the pressure inside the upper space 64 are reduced at the same time by the air supply and discharge mechanism section 60 which is separately connected to the container 56 and the lid body 58 (see also FIG. 9). After pressure reduction, as a result of only the upper space 64 first communicating with an external space (being opened to the atmosphere), the sticking film 28 is elastically deformed toward the lower space 62, which is in the pressure reduction state, and the decorative sheet S is stuck on the cowl C (see also FIG. 10). Thereafter, by the lower space 62 being opened to the atmosphere, the sticking film 28 is elastically restored (see also FIG. 11), the lid body 58 and the sticking tool 26 are taken out of the container 56, and the main sticking operation is completed.

Hereinafter, each component will be described in detail. As depicted in FIGS. 1 and 2, the housing 54 is a box which is provided across the first and second main sticking units 20 and 24, and houses the containers 56 of the first and second main sticking units 20 and 24. At the upper surface of the housing 54, upper ends 68*a* of the containers 56 of the first and second main sticking units 20 and 24 are exposed.

As depicted in FIG. 4, the container 56 is formed into a cylindrical shape having a bottom wall 66 in the form of a circle when viewed in a plan view, and a side wall 68 extending upward from the peripheral edge of the bottom wall 66, and has the lower space 62 formed therein. The upper end 68*a* of the side wall 68 forms an upper-end opening 70 of the lower space 62. An inner surface of the upper-end opening 70 is formed so as to fix the shape of the sticking tool 26 (the holding frame 46) when viewed in a plan view. Moreover, at the upper end 68*a*, a packing (not shown) which comes into contact with the sticking tool 26 in an airtight manner is preferably provided.

As depicted in FIG. 4, in the lower space 62 of the container 56, a jig 72 on which the cowl C is placed by the worker W or an unillustrated conveying apparatus is provided. The jig 72 is formed into the shape of a block and placed on a bottom plate 78, which will be described later. An upper end 72*a* of the jig 72 is formed into a shape which can make partial surface contact with the inner surface of the cowl C in order to support the cowl C at a desired height position and in a desired posture.

Moreover, in the container 56, a restriction mechanism section 74 that restricts the elastic deformation of the sticking film 28 around the cowl C is provided. The restriction mechanism section 74 includes a block 76, the bottom plate 78, a pillar portion 80, a restriction plate 84 (a restricting section), and a cushion 86 (a shock-absorbing section).

The block 76 is formed so as to have a lower surface that coincides with the bottom wall 66 and a lower-side inner surface of the side wall 68, and is housed and fixed in a lower part of the container 56. The upper surface of the block 76 is formed so as to be flat and is horizontal in the container 56. In a central part of the block 76, a central hole 76*a* vertically passing through the block 76 is provided.

The bottom plate 78 is put on the upper surface of the block 76 and supports the above-described jig 72 on a central part thereof facing the central hole 76*a*. The bottom plate 78 is provided with a plurality of pores 78*a* vertically passing through the bottom plate 78, which allow air to flow through the bottom plate 78 upward and downward.

The pillar portion 80 is a cylindrical member that fixes and supports the restriction plate 84. A plurality of the pillar portions 80 are arranged on the bottom plate 78 at intervals around the jig 72 and extend upward from the bottom plate 78. The upper ends of the pillar portions 80 are set at positions corresponding to the upper end 72*a* of the jig 72, to thereby horizontally support the restriction plate 84 at a predetermined height position. The component that supports the restriction plate 84 is not limited to the pillar portions 80, and may be, for example, a wall or block having cavities that allow the air in the lower space 62 to flow therethrough; in this case, a porous body may be used for the wall or block itself.

The restriction plate 84 has sufficient stiffness and is formed into a disk shape having a diameter which is slightly smaller than that of the inner periphery of the side wall 68 when viewed in a plan view. The upper surface of the restriction plate 84 serves as a receiving surface 85 that restricts the elastic deformation of the sticking film 28 around the cowl C. The height position of the restriction plate 84 is set, by the pillar portions 80, to a position at which the receiving surface 85 can make contact with the sticking film 28 while a sticking-target area of the cowl C being exposed above. For instance, the height position of the receiving surface 85 is set so as to be the same as the height position of the peripheral edge of the cowl C supported by the jig 72. Alternatively, the height position of the receiving surface 85 may be set so as to be the same as the height position of the lowermost part (the peripheral edge of the cowl C in an example depicted in the drawing) of the three-dimensional cowl C in a state in which the cowl C is supported by the jig 72.

The restriction plate 84 has, in a central part thereof, a large hole 84*a* (a hole portion) in which the cowl C can be placed and through which the cowl C can pass, and has a plurality of small holes 84*b* (hole portions) around the large hole 84*a*. The large hole 84*a* is formed into a circular shape when viewed in a plan view, and the inside diameter thereof is set so as not to make contact with the cowl C. As a result, when being fixed to the jig 72, the cowl C is placed at a position close to the restriction plate 84. A configuration may be adopted in which the large hole 84*a* is formed so as to be fitted to the peripheral part of the cowl C when viewed in a plan view, and the peripheral part of the cowl C is fixed in contact with the restriction plate 84.

On the other hand, the plurality of small holes 84*b* are formed so as to be sufficiently smaller than the large hole 84*a* and are formed in a thickness direction of the restriction plate 84 (that is, so as to pass through the restriction plate 84 between the receiving surface 85 and an opposite face thereof). The large hole 84*a* and the plurality of small holes 84*b* allow air above the restriction plate 84 and air below the restriction plate 84 to flow and pass through the restriction plate 84. The configuration of the large hole 84*a* or the small holes 84*b* is not limited to a particular configuration, and the large hole 84*a* or the small holes 84*b* may be set to have various shapes or be arranged in various ways as long as the configuration allows air in the lower space 62 to flow upward and downward. Alternatively, the restriction plate 84 itself may be made up of a porous body that allows air to pass therethrough, without the small holes 84*b*.

The cushion 86 is formed of a material which is more pliant than the restriction plate 84, and is formed into an annular body that circumferentially extends in a circumferential direction of the restriction plate 84 on the receiving surface 85 of the restriction plate 84 and on a peripheral part thereof close to the radial outside. The upper end of the cushion 86 reaches the upper end 68*a* of the container 56 and is in contact with or is close to the holding frame 46 in a state in which the sticking tool 26 is placed. The inner side of the cushion 86 is formed into a tapered face 86*a* whose diameter decreases from the upper end downward. The peripheral part of the sticking film 28 makes contact with the tapered face 86*a* of the cushion 86 when the sticking film 28 is elastically deformed, and the tapered face 86*a* of the cushion 86 mitigates the elastic deformation of the peripheral part of the sticking film 28. Preferably, this cushion 86 also has a hole 86*b* which allows air to flow therethrough.

As depicted in FIGS. 2 and 4, a container-side air supply and discharge tube 88 of the air supply and discharge mechanism section 60 is coupled to the outside of the container 56 (the lower central part of the bottom wall 66). The container-side air supply and discharge tube 88 has a communicating path 88*a* communicating with the lower space 62, and which allows the container-side air supply and discharge tube 88 to discharge air from the lower space 62 or supply air to the lower space 62.

The container-side air supply and discharge tube 88 is connected as one tube to the container 56, and has a T-shape that branches off in two directions outside the container 56. The insides of the two branches of the container-side air supply and discharge tube 88, which branches off in two directions outside the container 56, are provided respectively with valves 90*a* and 90*b*, which open and close the communicating path 88*a*, of the air supply and discharge mechanism section 60 (see also FIG. 5). In addition, to one end, on the outside, of the container-side air supply and discharge tube 88 at which the valve 90*a* is provided, a pipe 92*a* of the air supply and discharge mechanism section 60 is connected, and the other end at which the valve 90*b* is provided can be opened to the external space.

Referring back to FIGS. 1 and 2, the first conveying unit 30 of the sticking apparatus 10 conveys the sticking tool 26 between the above-described first temporary sticking unit 18 and first main sticking unit 20. This first conveying unit 30 is provided on the base 34 on the Y1 side of the first sticking station 12 and configured so as to reciprocate in the arrow X direction. Moreover, the second conveying unit 32 is also provided on the base 34 on the Y1 side of the second sticking station 14 and configured so as to make the sticking tool 26 reciprocate between the second temporary sticking unit 22 and the second main sticking unit 24.

The first conveying unit 30 includes a rail 94 fixed to the base 34 and which extends in the arrow X direction, a moving apparatus 96 that moves along the rail 94, and a lifting mechanism 98 provided in the moving apparatus 96 and configured to lift the sticking tool 26. The moving apparatus 96 has a power source 96*a* and an unillustrated wheel. Under driving operation of the power source 96*a*, the wheel rolls on the rail 94, whereby the moving apparatus 96 itself reciprocates in the arrow X direction.

The lifting mechanism 98 includes a supporting body 98*a* extending upward from the moving apparatus 96, and a pair of lifting claws 98*b* (see FIG. 3) that is fixed to an upper portion of the supporting body 98*a* and extends toward the Y2 side in FIG. 1. The supporting body 98*a* moves upward and downward together with the lifting claws 98*b* by a drive source 98*c* provided in the moving apparatus 96. Moreover, the pair of lifting claws 98*b* has unillustrated positioning pins at predetermined positions (positions facing the positioning holes 46*a* of the sticking tool 26) on the lower surface thereof. An electromagnet is provided in the positioning pins or portions of the lifting claws 98*b* around the positioning pins, and the lifting mechanism 98 generates a magnetic force when the lifting claws 98*b* come into contact with the sticking tool 26.

The lifting mechanism 98 lifts the sticking tool 26 from the first sticking station 12 by moving the supporting body 98*a* upward in a state of attracting the sticking tool 26 thereto by the magnetic force. Then, the first conveying unit 30 moves in the arrow X direction under the operation of the moving apparatus 96 in a state where the sticking tool 26 is attracted to the lifting claws 98*b*. After positioning the sticking tool 26 above the placement section 40 of the first temporary sticking unit 18 or above the container 56 of the first main sticking unit 20, the first conveying unit 30 places the sticking tool 26 in the placement section 40 or the container 56 by lowering the lifting claws 98*b* and stopping the driving of the electromagnet. The sticking tool 26 is properly fixed in the placement section 40 or the container 56 by an internal magnet without any positional deviation.

The first main sticking unit 20 performs an operation to close the container 56 with the lid body 58 for a main sticking operation in a state in which the sticking tool 26 is placed on the container 56. In the sticking apparatus 10, the first and second main sticking units 20, 24 share one lid body 58 (i.e., the lid body 58 is common to the sticking units 20, 24). That is, the lid body 58 is configured so as to be detachably attached to the containers 56 of the first and second main sticking units 20, 24, and move between the first main sticking unit 20 and the second main sticking unit 24 by the driving action of a lid body driving section 100 (a lid body driving unit).

As depicted in FIGS. 1 and 4, the lid body 58 is formed into a cylindrical shape having a vertical thickness which is slightly smaller than that of the container 56. This lid body 58 has an upper wall 102 in the form of a circle when viewed in a plan view and a side wall 104 that protrudes downward from the peripheral edge of the upper wall 102, and has the upper space 64 therein. A lower end 104*a* of the side wall 104 forms a circular lower-end opening 106 where the upper space 64 is open. The lower end 104*a* of the lid body 58 and the upper end 68*a* of the container 56 are provided with respective coupling/fixing mechanisms (not shown) that can be detachably attached to each other. The coupling/fixing mechanisms are not limited to particular coupling/fixing mechanisms. For example, there is included a configuration in which a lever provided on the upper end 68*a* of the container 56 and a hook provided on the lower end 104*a* of the lid body 58 automatically engage with each other as a result of downward movement of the lid body 58. Alternatively, the coupling/fixing mechanisms may be a configuration in which the container 56 and the lid body 58 are provided with respective fitting faces that are capable of being taper-fitted with each other.

A lid body-side air supply and discharge tube 108 of the air supply and discharge mechanism section 60 is coupled to a central part of the upper wall 102. The lid body-side air supply and discharge tube 108 has a communicating path 108*a* communicating with the upper space 64, and is T-shaped, similarly to the container-side air supply and discharge tube 88. The insides of two branches of the lid body-side air supply and discharge tube 108, which branches off in two directions outside the lid body 58, are equipped with respective valves 90*e* and 90*f*, which open and close the communicating path 108*a*, of the air supply and discharge mechanism section 60 (see also FIG. 5). In addition, to one end, on the outside, of the lid body-side air supply and discharge tube 108 at which the valve 90*e* is provided, a pipe 92*d* of the air supply and discharge mechanism section 60 is connected, and the other end at which the valve 90*f* is provided can be opened to the external space.

Figure 6:
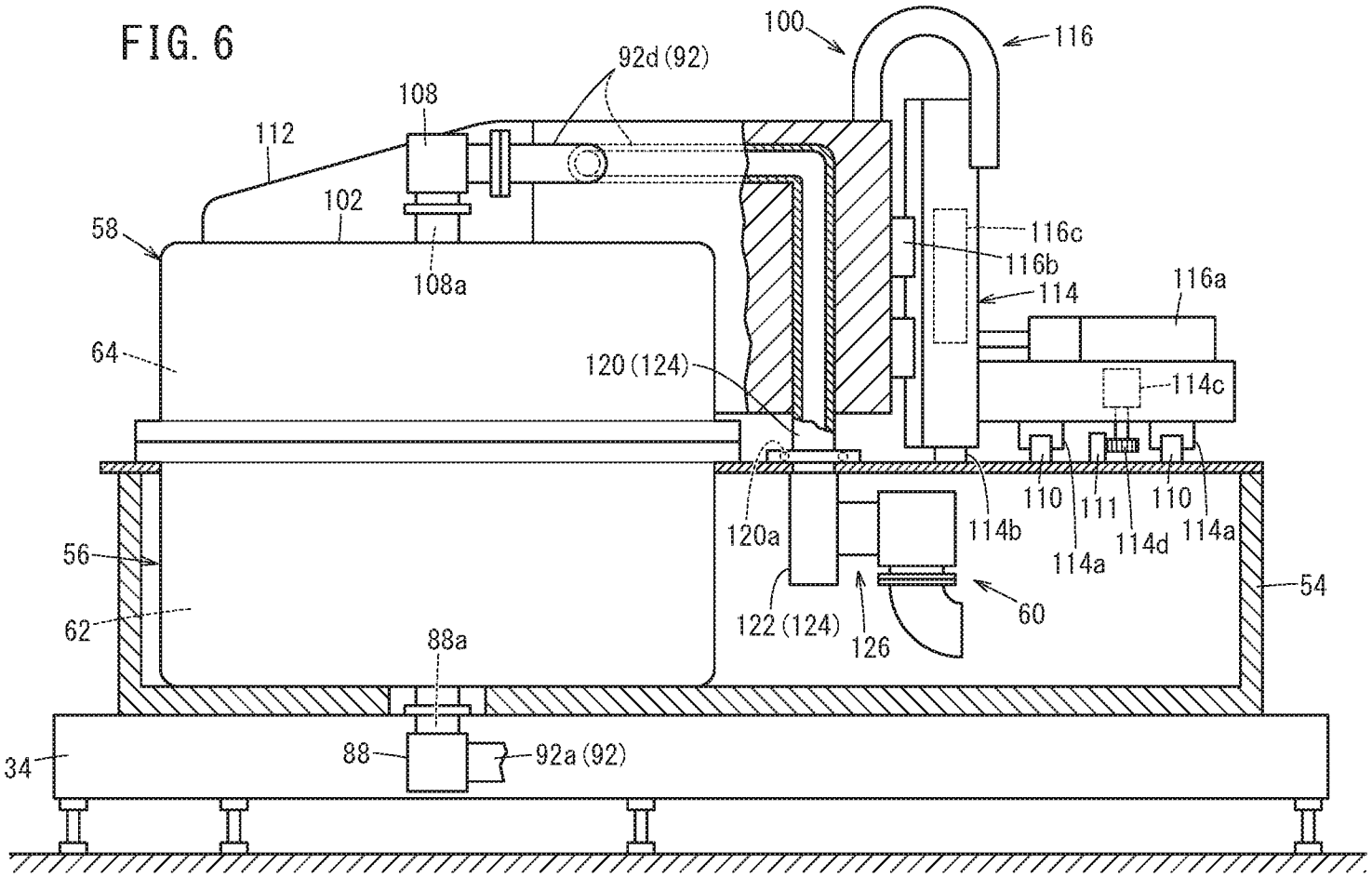
FIG. 6 is a partial side sectional view depicting part of a lid body driving section and the air supply and discharge mechanism section of the sticking apparatus of FIG. 1.

The lid body 58 is configured so as to move in an X direction and vertically move upward and downward by the lid body driving section 100 depicted in FIG. 1. As depicted in FIG. 6, the lid body driving section 100 includes an arm 112 that supports and couples the upper wall 102 of the lid body 58 thereon, a slider 114 that supports the arm 112, a pair of guide rails 110 that guides the slider 114 for sliding motion, and a rack 111. Moreover, the slider 114 is provided with an up-and-down movement mechanism 116 that changes the height of the arm 112.

The arm 112 is formed as a frame having a parallel cross shape when viewed in a plan view, and extends from the slider 114 in a diametrical direction of the lid body 58 with the lid body-side air supply and discharge tube 108 being interposed therebetween. By the lower side of the frame being coupled to the upper surface of the lid body 58, the arm 112 firmly fixes the lid body 58. Moreover, on one side surface of the arm 112, the pipe 92*d* of the air supply and discharge mechanism section 60, which is shared by the first and second main sticking units 20, 24 as in the case of the lid body 58, is provided. The pipe 92*d* extends from the lid body-side air supply and discharge tube 108, and thereafter is inserted into the arm 112 at a certain position along the arm 112. Then, the pipe 92*d* is connected to a movable-side terminal 120 provided at a lower position of the arm 112 on the proximal-end side thereof (the Y1 side). The movable-side terminal 120 is one component of a coupling mechanism 124 that moves downward together with the lid body 58 and is connected to a fixed-side terminal 122 provided on the housing 54, of the first or second main sticking unit 20 or 24.

Meanwhile, the slider 114 is formed into a substantially L-shaped box that extends in a Y direction on the upper surface of the housing 54 and then extends upward from the extended end thereof. The slider 114 has, on a lower surface thereof, slide guides 114*a* that are guided along the pair of guide rails 110, and an auxiliary tire 114*b* that can roll on the housing 54. Moreover, the slider 114 contains therein a rotary drive source 114*c* such as a motor, and a pinion 114*d* that rotates and meshes with the rack 111 by receiving a rotary driving force transmitted from the rotary drive source 114*c* is arranged on the lower surface of the slider 114.

The up-and-down movement mechanism 116 includes a cylinder 116*a* that is fixed to the slider 114, a movable body 116*b* to which the arm 112 is attached and which can be displaced along with the up-and-down movement of the slider 114, and a drive transmitting section 116*c* that converts drive power of the cylinder 116*a* into moving force of the movable body 116*b*. In addition, the up-and-down movement mechanism 116 moves the arm 112 upward and downward while maintaining the extended posture of the arm 112 in a planar direction. At this time, the lid body 58 is also displaced upward and downward relative to the container 56 while maintaining a horizontal posture, and thereby attached to or detached from the container 56.

Moreover, the pair of guide rails 110 and the rack 111 are laid out on the upper surface of the housing 54 so as to extend slightly beyond the center of each of the containers 56 of the first main sticking unit 20 and the second main sticking unit 24. By moving the slider 114 in the X direction (see FIG. 1) by rotation of the pinion 114*d* with respect to the rack 111, the lid body driving section 100 slides the lid body 58 linearly between the container 56 of the first main sticking unit 20 and the container 56 of the second main sticking unit 24. The lid body driving section 100 preferably includes a sensor that detects a movement limit of the slider 114 in the X direction.

Figure 5:
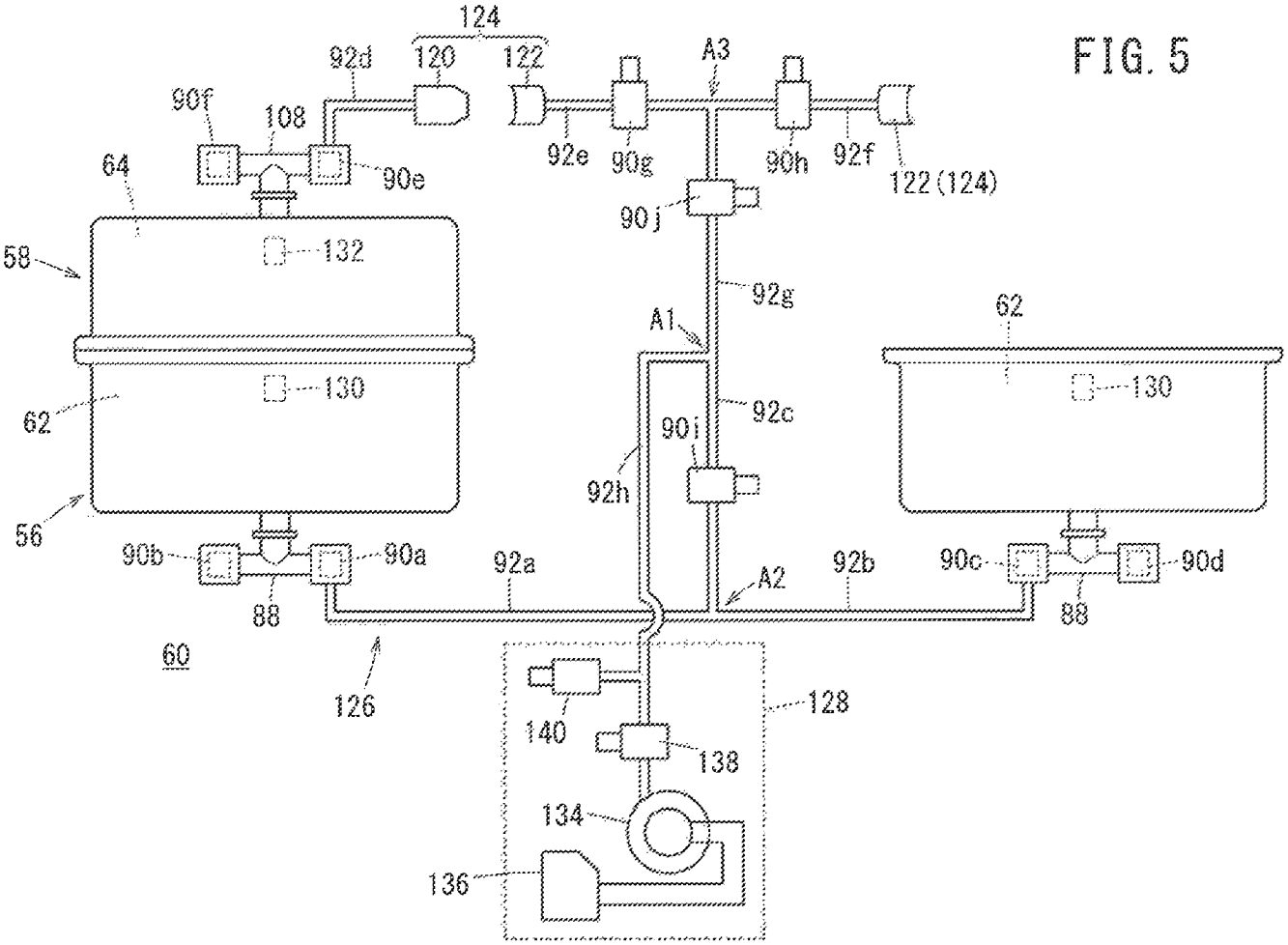
FIG. 5 is an explanatory diagram depicting an air supply and discharge mechanism section of the sticking apparatus of FIG. 1.

After attaching the lid body 58 to one of the containers 56 of the first and second main sticking units 20, 24 with the lid body driving section 100, the sticking apparatus 10 changes pressures inside the closed container 56 and lid body 58 with the air supply and discharge mechanism section 60 depicted in FIG. 5. The air supply and discharge mechanism section 60 includes the above-described tubular bodies (the container-side air supply and discharge tube 88 and the lid body-side air supply and discharge tube 108), a gas flow circuit 126 that is made up of a plurality of pipes 92, a plurality of valves 90 that are provided in the tubular bodies and the gas flow circuit 126, and a suction mechanism 128. Furthermore, the air supply and discharge mechanism section 60 includes a lower pressure sensor 130 (a first measuring unit) which detects a pressure inside the lower space 62 and an upper pressure sensor 132 (a second measuring unit) which detects a pressure inside the upper space 64.

In the gas flow circuit 126, the plurality of pipes 92 are connected together in a converging manner or a branching manner by unillustrated joints, and air is suctioned and supplied. Specifically, the plurality of pipes 92 include the pipe 92*a* that is connected to the container-side air supply and discharge tube 88 of the first main sticking unit 20, a pipe 92*b* that is connected to the container-side air supply and discharge tube 88 of the second main sticking unit 24, a pipe 92*c* into which these pipes 92*a*, 92*b* converge, the pipe 92*d* that is connected to the lid body-side air supply and discharge tube 108 and extends to the above-described movable-side terminal 120, a pipe 92*e* that is connected to the fixed-side terminal 122 of the first main sticking unit 20, a pipe 92*f* that is connected to the fixed-side terminal 122 of the second main sticking unit 24, a pipe 92*g* into which these pipes 92*e* and 92*f* converge, and a pipe 92*h* into which the pipe 92*c* and the pipe 92*g* converge and which is connected to the suction mechanism 128.

That is, the pipe 92*h* forms a converging flow channel through which all the spaces (the container 56 of the first main sticking unit 20, the container 56 of the second main sticking unit 24, and the lid body 58) to be depressurized in the sticking apparatus 10 communicate with the suction mechanism 128. Moreover, the pipe 92*c* that branches off from the pipe 92*h* at a meeting point A1, and the pipe 92*a* and the pipe 92*b* that branch off from the pipe 92*c* at a meeting point A2 jointly form a first flow channel that communicates with the lower space 62 of each container 56. Furthermore, the pipe 92*g* that branches off from the pipe 92*h* at the meeting point Al, the pipes 92*e*, 92*f* that branch off from the pipe 92*g* at a meeting point A3, and the pipe 92*d* that is connected to and disconnected from the pipes 92*e*, 92*f* by the coupling mechanism 124 jointly form a second flow channel that communicates with the upper space 64 of the lid body 58.

Meanwhile, the plurality of valves 90 are provided in the tubular bodies and at positions on the pipes 92. Specifically, the plurality of valves 90 include the valves 90*a*, 90*b* which are provided in the container-side air supply and discharge tube 88 of the first main sticking unit 20, valves 90*c*, 90*d* which are provided in the container-side air supply and discharge tube 88 of the second main sticking unit 24, the valves 90*e*, 90*f* which are provided in the lid body-side air supply and discharge tube 108, a valve 90*g* which is provided in the pipe 92*e*, a valve 90*h* which is provided in the pipe 92*f*, a valve 90*i* which is provided in the pipe 92*c*, and a valve 90*j* which is provided in the pipe 92*g*.

The valves 90*a* to 90*i* are connected to the controller 16, and as the valves 90*a* to 90*i*, a two-way valve (for example, a solenoid valve) which opens and closes under control of the controller 16 is used. Moreover, as the valve 90*j*, a valve mechanism (for example, a butterfly valve: a flow rate regulating mechanism) which can regulate the flow rate of air by changing the degree of opening based on the control of the controller 16 is used. The valve 90*i* may not be provided.

As depicted in FIG. 1, the suction mechanism 128 is installed outside (on the Y1 side of) the first sticking station 12. The suction mechanism 128 depressurizes the lower space 62 and the upper space 64 under control of the controller 16 by applying a suction force to one of the containers 56 of the first and second main sticking units 20, 24 that has the sticking tool 26 and the lid body 58 attached thereto. The configuration of the suction mechanism 128 is not limited to a particular configuration; for instance, as depicted in FIG. 5, a configuration may be adopted that includes a vacuum pump 134, a chiller 136 that adjusts the temperature of the vacuum pump 134, and a valve 138 and a discharge vent 140 which are provided between the pipe 92*h* and the vacuum pump 134. Operations of the air supply and discharge mechanism section 60 including this suction mechanism 128 will be described later.

Moreover, the coupling mechanism 124 of the air supply and discharge mechanism section 60 selectively connects the pipe 92*d* provided in the arm 112 to the pipe 92*e* of the first main sticking unit 20 or the pipe 92*f* of the second main sticking unit 24. As depicted in FIG. 6, the movable-side terminal 120 of the coupling mechanism 124 is formed into a cylindrical body having an upper side coupled to the pipe 92*d* and which protrudes downward from the arm 112. The lower end of the movable-side terminal 120 is located at a lower level than the lower-end opening 106 of the lid body 58. Moreover, the movable-side terminal 120 has, on a lower end face thereof, an 0-ring 120*a* that can make contact with the fixed-side terminal 122.

The fixed-side terminal 122 is a cylindrical body having an inside diameter that is equal to the inside diameter of the movable-side terminal 120, and is provided, one for each of the first and second main sticking units 20 and 24, on the housing 54. The fixed-side terminals 122 are provided at respective positions which each overlap with the center of the container 56 in the X direction and which overlap with one another in the Y direction when viewed in a plan view. The two fixed-side terminals 122 are connected respectively to the pipes 92*e*, 92*f*. The upper end of the fixed-side terminal 122 slightly protrudes from the housing 54, and an upper end face thereof is formed so as to be flat, whereby the upper end of the fixed-side terminal 122 can make contact with the movable-side terminal 120 having the O-ring 120*a* in an airtight manner.

The movable-side terminal 120 is displaced in accordance with the movement of the arm 112 in the X direction by the lid body driving section 100, and when the lid body 58 is placed above the container 56, the movable-side terminal 120 is placed right above the fixed-side terminal 122. Moreover, the movable-side terminal 120 moves downward in accordance with the downward movement of the arm 112 by the lid body driving section 100 and comes close to the upper end face of the fixed-side terminal 122 (is brought into a floating state). Then, by receiving the suction force from the suction mechanism 128, the coupling mechanism 124 attracts the movable-side terminal 120 to the fixed-side terminal 122 by suction, to thereby couple the movable-side terminal 120 to the fixed-side terminal 122. This makes it possible for the air supply and discharge mechanism section 60 to suction air from the upper space 64 suitably. The coupling mechanism 124 is not limited to the above-described configuration, and can adopt various components that can be detachably coupled to each other. For instance, the coupling mechanism 124 can adopt tapered shapes that can be fitted with each another or an engagement structure in which hooks are engaged with each other. The movable-side terminal 120 and the fixed-side terminal 122 may be coupled to each other at the time of downward movement of the arm 112 without the help of the suction force.

Moreover, as the controller 16 of the sticking apparatus 10, a computer having an arithmetic processing unit, a storage unit, and an input/output unit, which are not shown, is used. By executing a control program which is stored in the storage unit, the arithmetic processing unit of the controller 16 causes the first and second sticking stations 12 and 14 to operate in conjunction with each other and further causes the lid body driving section 100 and the air supply and discharge mechanism section 60 to operate, whereby a sticking operation is performed.

The sticking apparatus 10 according to the present embodiment is basically configured as described above. Hereinafter, operations and effects thereof will be described.

As described above, in the sticking operation performed by the sticking apparatus 10, temporary sticking (a first sticking step) to stick the decorative sheet S on the sticking film 28 is performed first, and main sticking (a second sticking step) to stick the decorative sheet S, which is stuck on the sticking film 28, on the cowl C is then performed. Between the temporary sticking and the main sticking, a movement operation (a movement step) to move the sticking tool 26, which are used by each of the first and second sticking stations 12, 14, and also move the lid body 58 is performed.

Figure 7:
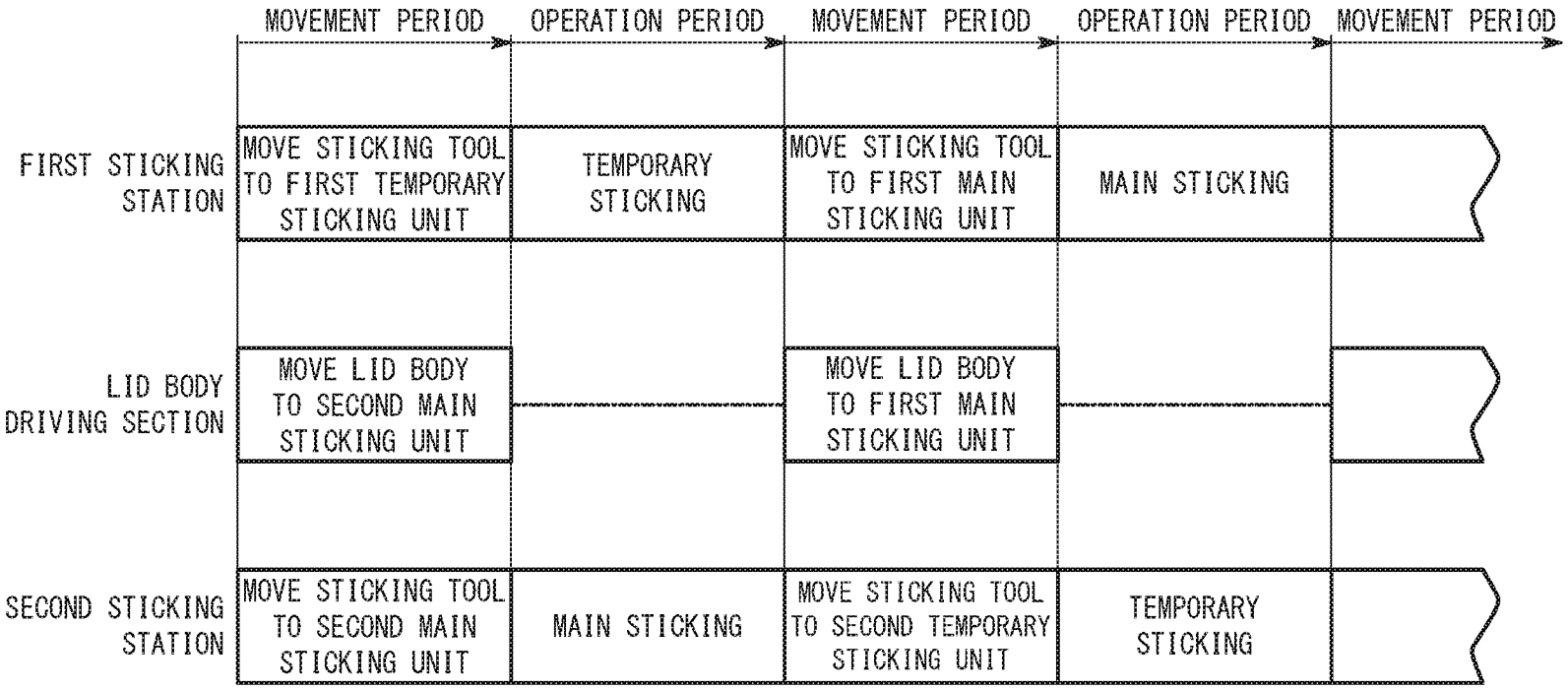
FIG. 7 is a timing diagram showing the operating state of the sticking apparatus.

As shown in FIG. 7, the controller 16 promotes the efficiency of operations by shifting the operation timing of the first sticking station 12 and the second sticking station 14. That is, when temporary sticking is performed in the first temporary sticking unit 18 of the first sticking station 12, main sticking is performed in the second main sticking unit 24 of the second sticking station 14. On the other hand, when main sticking is performed in the first main sticking unit 20 of the first sticking station 12, temporary sticking is performed in the second temporary sticking unit 22 of the second sticking station 14. Hereinafter, also when an operation of sticking is explained, description concerning the first sticking station 12 will be representatively given, and an operation of the second sticking station 14 will be described if necessary.

In the first sticking station 12, before temporary sticking is performed, the decorative sheet S is placed by the worker W in a marked area on the placement section 40 of the first temporary sticking unit 18. The worker W stands on the Y2 side of the sticking apparatus 10, for example, and places the decorative sheet S such that the sticking surface Sa thereof faces the upper surface of the disk-shaped body 44. The marked area may be formed by, for example, providing a light-emitting device above or below the placement section 40 and irradiating the disk-shaped body 44 with light (such as laser light). This makes it possible to position the decorative sheet S accurately on the disk-shaped body 44.

In a state in which the decorative sheet S is placed, the controller 16 proceeds to the movement operation (the movement step: a movement period). At the time of this movement operation, in the first sticking station 12, the first conveying unit 30 conveys the sticking tool 26 to the placement section 40 of the first temporary sticking unit 18 as depicted in FIG. 3. That is, the first conveying unit 30 stably lifts the sticking tool 26 by an electromagnetic force of the pair of lifting claws 98*b*, moves the sticking tool 26 to a position right above the disk-shaped body 44 of the placement section 40, and then lowers the lifting claws 98*b*. As a result, the holding frame 46 of the sticking tool 26 is placed on the peripheral edge of the disk-shaped body 44, and the positioning protrusions 40*a* are inserted into the lower-side positioning holes 46*b*, whereby positioning of the sticking tool 26 is performed. At this time, by stopping the magnetization of the lifting claws 98*b* and magnetizing the positioning protrusions 40*a*, the sticking tool 26 is firmly fixed. In this state, the decorative surface Sb of the decorative sheet S placed on the disk-shaped body 44 faces a predetermined position of the lower surface of the sticking film 28.

On the other hand, during this movement period, the second sticking station 14 moves the sticking tool 26 to the container 56 of the second main sticking unit 24 from the placement section 40 of the second temporary sticking unit 22 by the second conveying unit 32. Moreover, the lid body driving section 100 moves and attaches the lid body 58 to the container 56 of the second main sticking unit 24 in a state in which the sticking tool 26 is placed therein.

Next, in the first sticking station 12, temporary sticking (a temporary sticking step) is performed. Moreover, in the second sticking station 14, main sticking is performed (for operations at the time of main sticking, see an explanation of main sticking of the first sticking station 12, which will be given later).

In the temporary sticking operation, since the disk-shaped body 44 of the first temporary sticking unit 18 has a structure which is less likely to stick to the decorative sheet S, it is relatively easy to stick the decorative sheet S on the sticking film 28 placed on the placement section 40. At this time, the worker W may apply a pressing force to the placement position of the decorative sheet S by, for example, rubbing the placement position from the upper side of the sticking tool 26.

After completion of the temporary sticking, the controller 16 proceeds again to the movement operation (the movement step: the movement period). Before this movement operation is performed, an operation to place the cowl C in the container 56 is performed by the worker W or unillustrated conveying apparatus (a first step). At this time, the worker W puts (positions) the cowl C on the jig 72 protruding from the large hole 84*a* of the restriction plate 84 and places the cowl C in such a way that the peripheral part of the cowl C is located on the inside of the large hole 84*a*. As a result, a state in which only part of the cowl C is exposed on an upper side of the restriction plate 84 is brought about.

In the first sticking station 12, the first conveying unit 30 moves the sticking tool 26 to the container 56 of the first main sticking unit 20 from the placement section 40 of the first temporary sticking unit 18. Specifically, the first conveying unit 30 inserts the pair of lifting claws 98*b* in between the sticking tool 26 and the placement section 40, and then lifts the supporting body 98*a*, whereby the sticking tool 26 is placed on the pair of lifting claws 98*b*. Then, the first conveying unit 30 is moved in an X2 direction by the moving apparatus 96, and the sticking tool 26 is positioned immediately above the container 56 (see FIG. 8). Furthermore, by lowering the lifting claws 98*b*, the first conveying unit 30 places the sticking tool 26 on the container 56 in a state in which the holding frame 46 is aligned with the upper-end opening 70 of the container 56. In this placement state, the sticking surface Sa of the decorative sheet S stuck on the sticking film 28 faces the cowl C at the same height position as that of the upper end 68*a* of the container 56.

Moreover, at the start of the movement operation, the lid body driving section 100 separates the lid body 58, which was attached to the container 56 of the second sticking station 14 (the second main sticking unit 24), from this container 56 by lifting the lid body 58, so that the sticking tool 26 can be taken out of the container 56 of the second sticking station 14. After the separation, the slider 114 of the lid body driving section 100 moves the lid body 58 until the lid body 58 is located right above the border between the first main sticking unit 20 and the second main sticking unit 24, and then stands by until the sticking tool 26 is placed in the container 56 of the first main sticking unit 20.

Figure 8:
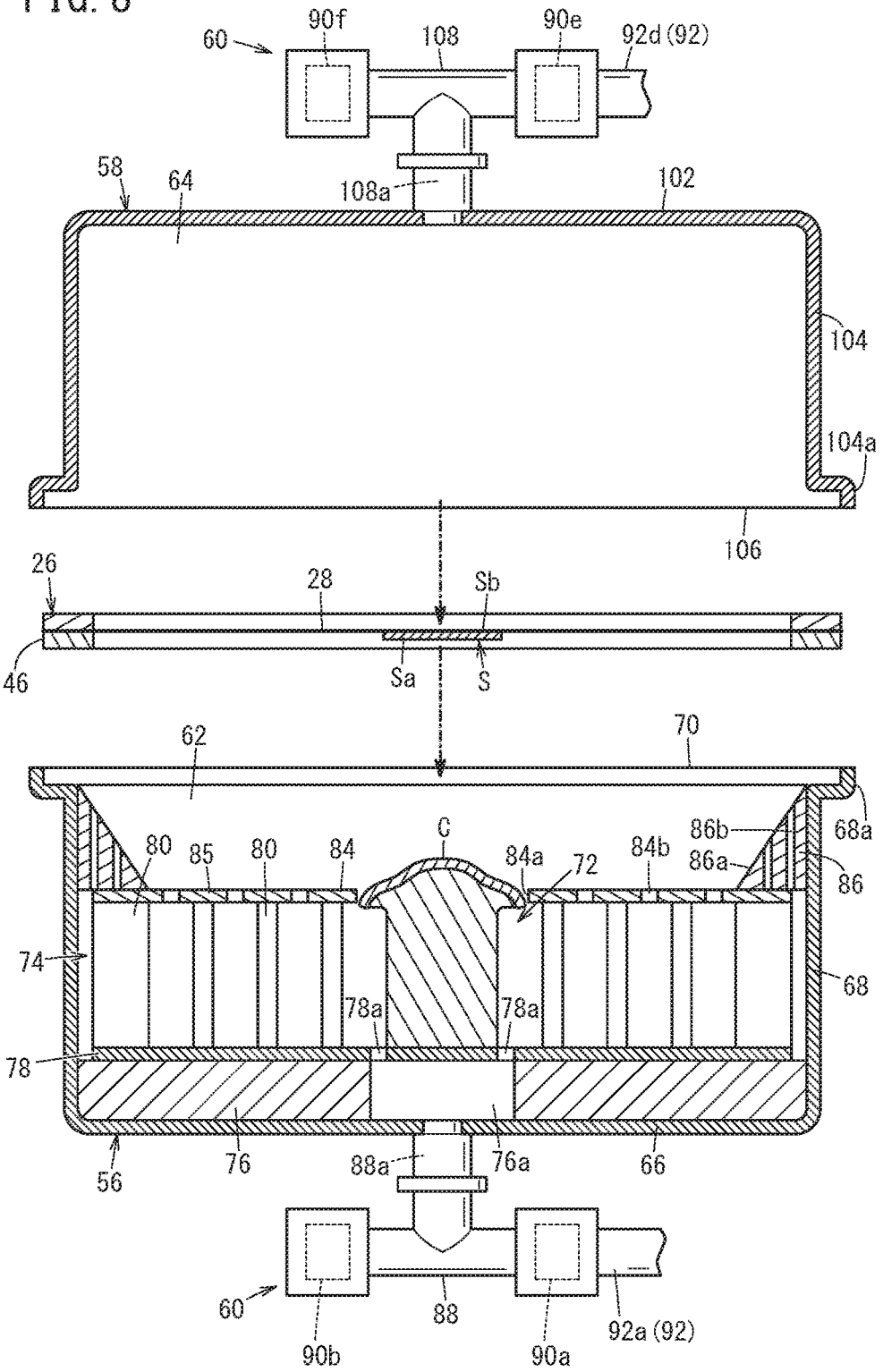
FIG. 8 is a first side sectional view that explains an operation of the sticking apparatus at the time of main sticking.

After the sticking tool 26 has been placed in the container 56, the lid body driving section 100 slides the slider 114 of the lid body driving section 100 and thereby disposes the lid body 58 above the container 56 as depicted in FIG. 8. Then, by lowering the arm 112 by the up-and-down movement mechanism 116, the lid body driving section 100 places the lid body 58 on the container 56 and the sticking tool 26. After the placement of the lid body 58, by driving the unillustrated coupling/fixing mechanisms provided around the container 56, the first main sticking unit 20 firmly fixes the peripheral edges of the container 56 and the lid body 58 to each other. As a result, as shown in FIG. 4, the container 56 and the lid body 58 are closed in an airtight manner.

Moreover, as depicted in FIG. 6, when the lid body 58 is placed above the container 56, the movable-side terminal 120 provided on the arm 112 is placed above the fixed-side terminal 122 of the first main sticking unit 20. Then, with the downward movement of the arm 112 at the time of placement of the lid body 58 on the container 56, the movable-side terminal 120 also moves downward, and comes close to the fixed-side terminal 122, and then a floating state is brought about.

Next, the controller 16 performs main sticking (a main sticking step) in the first sticking station 12. Moreover, in the second sticking station 14, temporary sticking is performed in the same manner as the above-described temporary sticking performed in the first sticking station 12.

In the main sticking operation, by driving the air supply and discharge mechanism section 60, first, the controller 16 concurrently depressurizes the lower space 62 which is formed between the container 56 and the sticking film 28 and the upper space 64 which is formed between the lid body 58 and the sticking film 28 as depicted in FIG. 9 (a second step). Specifically, the controller 16 imparts a suction force to the pipe 92*h* by using the suction mechanism 128, and brings the valves 90*a*, 90*e*, 90*g*, 90*i*, and 90*j* of the gas flow circuit 126 and the valve 138 of the suction mechanism 128 shown in FIG. 5 into an opened state. The valves 90*b*, 90*e* are brought into a closed state to prevent air from being taken in from the external space. Moreover, to prevent air from being suctioned from the second sticking station 14, the valves 90*c*, 90*h* are closed (conversely, when main sticking is performed in the second sticking station 14, the valves 90*a*, 90*g* are closed).

As a result, as depicted in FIG. 9, the suction mechanism 128 discharges the air from the lower space 62 to the outside of the container 56. At this time, in the lower space 62, it is possible to flow the air present above the restriction plate 84 toward the lower side of the restriction plate 84 through the large hole 84*a* and the small holes 84*b* while maintaining a sealed state by the sticking film 28. Then, the air passes through the block 76 and the pores 78*a* of the bottom plate 78 and flows out through the communicating path 88*a* of the container-side air supply and discharge tube 88. As a result, the pressure inside the lower space 62 is evenly reduced.

Moreover, the coupling mechanism 124 attracts the movable-side terminal 120 toward the fixed-side terminal 122 by the suction force and firmly couples the terminals to each other. After this coupling, the suction mechanism 128 discharges the air from the upper space 64 to the outside of the lid body 58 through the lid body-side air supply and discharge tube 108.

Then, at the time of depressurizing, the controller 16 regulates the rate of discharge of the air from the upper space 64. That is, the volumes of the lower space 62 and the upper space 64 are different from each other. For this reason, if suction of air is performed at the same rate, the pressure inside the upper space 64 is reduced more quickly than the pressure inside the lower space 62. In order to deal with this, the controller 16 measures the pressure inside the lower space 62 using the lower pressure sensor 130 and measures the pressure inside the upper space 64 using the upper pressure sensor 132, and adjusts the degree of opening of the valve 90*j* (the butterfly valve) so that the pressures become equal to each other.

For example, at the start of discharge of air, the controller 16 discharges the air from the lower space 62 by fully opening the valve 90*i* and discharges the air from the upper space 64 by adjusting the degree of opening of the valve 90*j* so as to be smaller than the degree of the fully opened state. Then, if the measured pressure inside the upper space 64 is higher than the pressure inside the lower space 62, the controller 16 increases the rate of flow by increasing the degree of opening of the valve 90*j*, and if the pressure inside the upper space 64 is lower than the pressure inside the lower space 62, the controller 16 reduces the rate of flow by decreasing the degree of opening of the valve 90*j*. As a result, the pressures inside the lower space 62 and the upper space 64 are reduced while maintaining substantially equal pressures, and since the pressures inside the lower space 62 and the upper space 64 do not fluctuate, the elastic deformation of the sticking film 28 is suppressed.

The upper space 64 and the lower space 62 are depressurized to a predetermined pressure (for example, −2000 kPa), and the pressure reduction is ended by stopping operation of the suction mechanism 128 and closing the valves 90*a*, 90*e*, and 138. As a result, the lower space 62 and the upper space 64 are kept in a vacuum state (a state in which the pressures therein are reduced). Moreover, at the end of pressure reduction, in the suction mechanism 128, the discharge vent 140 is opened, and thus air is taken in the gas flow circuit 126 that is in a reduced pressure state. The air supply and discharge mechanism section 60 may perform a next third step without stopping depressurization of the internal spaces (in particular, the lower space 62).

Figure 10:
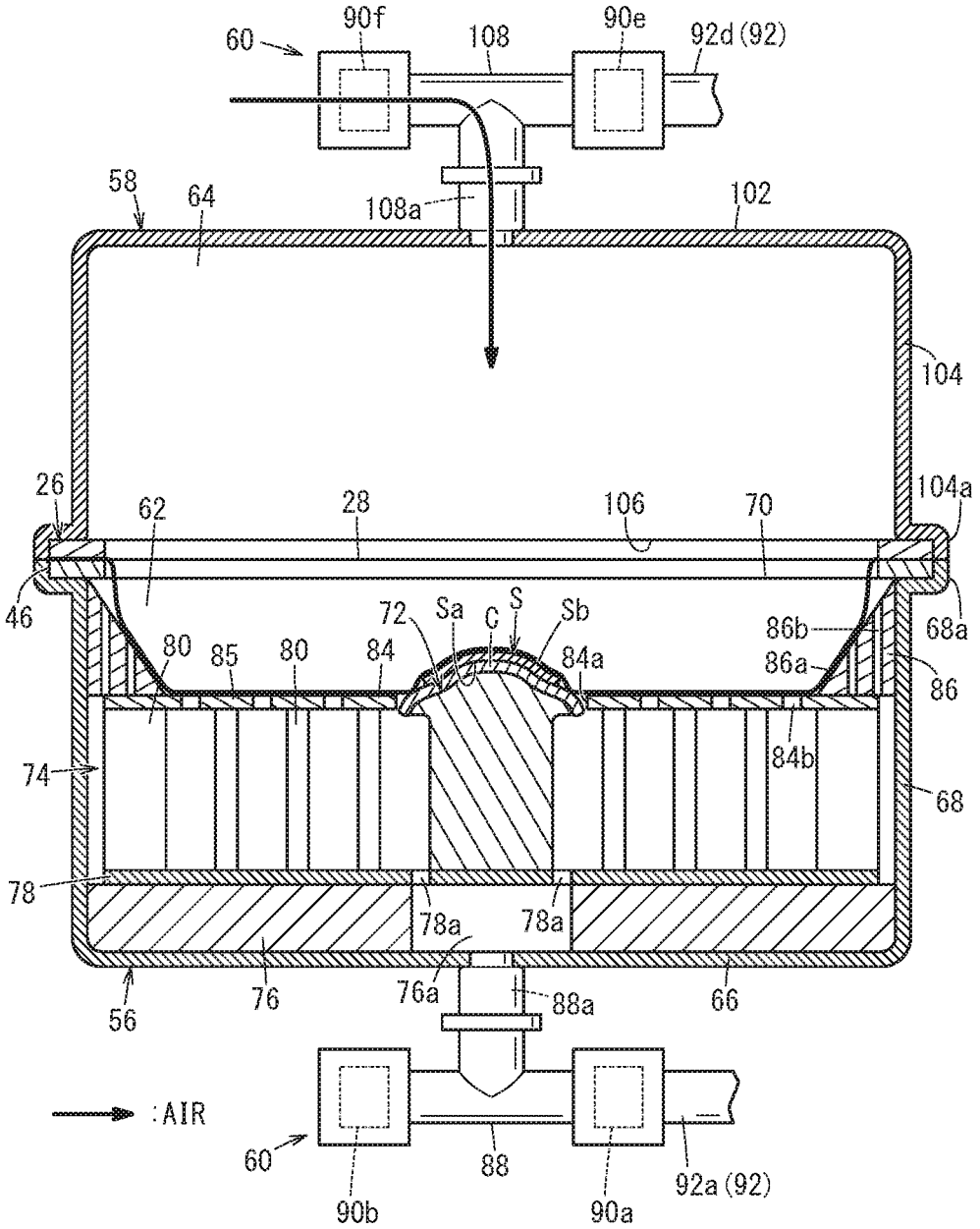
FIG. 10 is a third side sectional view that explains the operation of the sticking apparatus at the time of main sticking.

Next, the controller 16 causes only the upper space 64 to communicate with the external space, that is, to be open to the atmosphere, by opening the valve 90*f* in the lid body-side air supply and discharge tube 108 (a third step). As a result, air flows into the upper space 64, and, as shown in FIG. 10, the sticking film 28 is elastically deformed toward the lower space 62 that is in a reduced pressure state. The lower surface of the sticking film 28 and the upper surface of the cowl C make contact with each other, and the decorative sheet S stuck on the sticking film 28 is stuck on the cowl C. Since the decorative sheet S is accurately positioned on the sticking film 28 in the temporary sticking operation, the decorative sheet S is stuck on a desired position of the cowl C having a three-dimensional shape with a high degree of accuracy. Moreover, since the lower space 62 is in a vacuum state, the sticking surface Sa of the decorative sheet S is properly stuck on the surface of the cowl C with almost no air between the sticking surface Sa and the surface of the cowl C.

At this time, the restriction plate 84 in the container 56 makes contact with the sticking film 28 around the cowl C. Likewise, the cushion 86 placed on the peripheral part of the restriction plate 84 also makes contact with the peripheral part of the sticking film 28. As a result, the sticking film 28 is depressed in a stable shape along the receiving surface 85 of the restriction plate 84 and the tapered face 86*a* of the cushion 86, and excessive elastic deformation of the sticking film 28 in the downward direction is thus prevented. That is, the restriction mechanism section 74 can make it possible to suppress degradation of functions (rate of elongation, etc.) of the sticking film 28 caused by excessive elastic deformation thereof in the main sticking operation, and therefore the life of the sticking film 28 can be increased.

Figure 11:
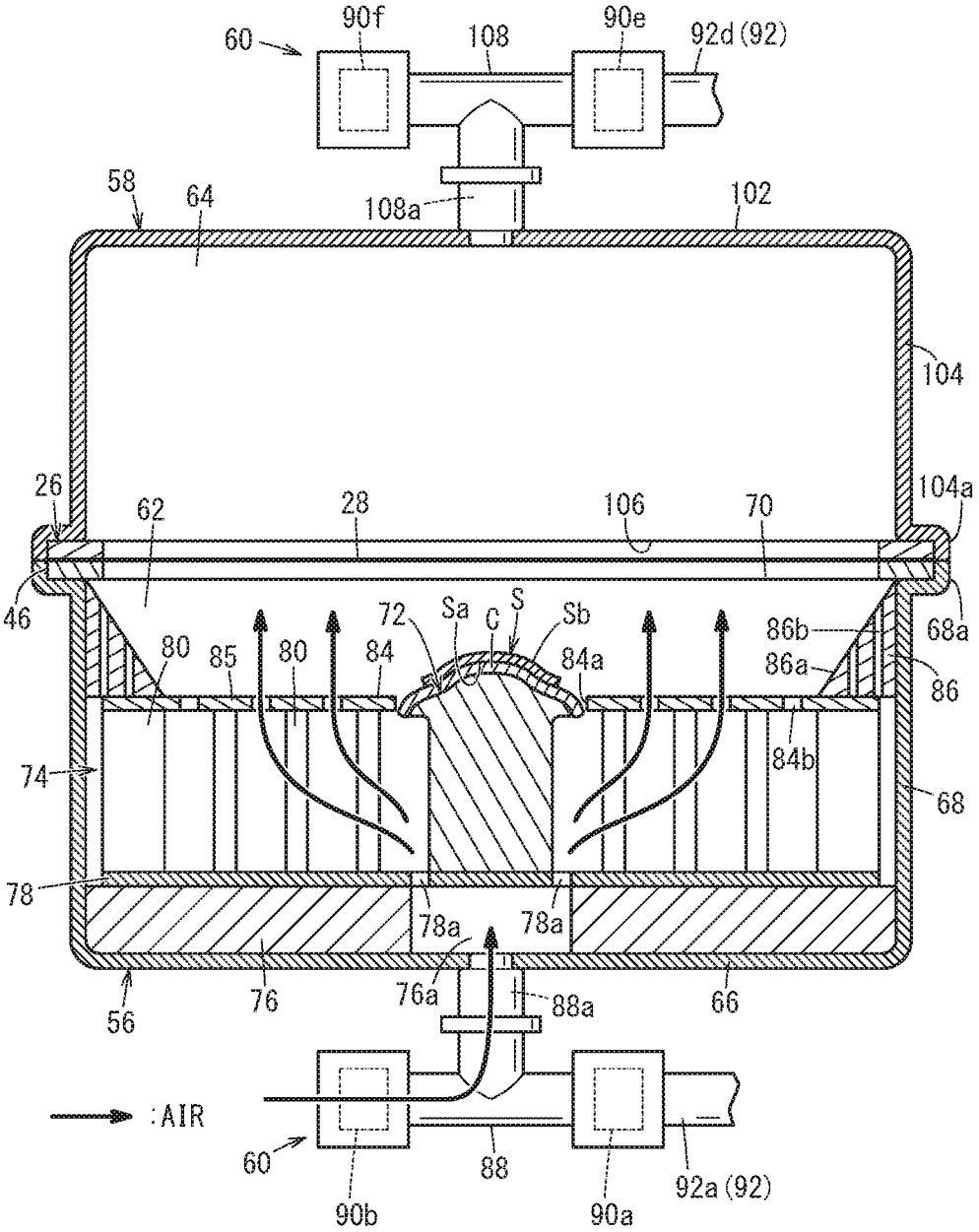
FIG. 11 is a fourth side sectional view that explains the operation of the sticking apparatus at the time of main sticking.

After sticking the decorative sheet S on the cowl C, the air supply and discharge mechanism section 60 opens the valve 90*b* of the container-side air supply and discharge tube 88 so that the lower space 62 communicates with the external space (i.e., open to the atmosphere) (a fourth step). As a result, air flows also into the lower space 62, and, as depicted in FIG. 11, the elastically deformed sticking film 28 is elastically restored and returns to the original position. As a result of the sticking surface Sa being stuck on the cowl C, the decorative sheet S is easily detached from the sticking film 28 on which the decorative sheet S is temporarily stuck, and then the decorative surface Sb is exposed on the surface of the cowl C. With the above operation, the main sticking operation is completed.

After completion of the main sticking, the first sticking station 12 performs the movement operation again to move the sticking tool 26 to the placement section 40 of the first temporary sticking unit 18. That is, the lid body 58 is detached from the container 56 by the lid body driving section 100, and the sticking tool 26 is lifted from the container 56 by the first conveying unit 30 and is moved to the first temporary sticking unit 18. The lid body 58 is moved to the container 56 of the second main sticking unit 24 in order to perform main sticking in the second sticking station 14.

As described above, in the sticking apparatus 10 and the sticking method according to the present embodiment, the first and second temporary sticking units 18, 22 and the first and second main sticking units 20, 24 are provided in different locations. Thus, in the first and second temporary sticking units 18 and 22, only the temporary sticking operation is performed, and thus it is possible to stick the decorative sheet S on the sticking film 28 easily and accurately. That is, with a simple configuration in which temporary sticking and main sticking are performed in different locations, the accuracy with which the decorative sheet S is stuck on the cowl C and operation efficiency are improved and the mass-production efficiency thereof can be further improved.

In this case, the sticking apparatus 10 can perform sticking more efficiently by the first and second sticking stations 12 and 14. Moreover, since the first and second sticking stations 12, 14 share the lid body 58, the cost of the apparatus is reduced and the cost of the sticking operation can also be greatly reduced. The sticking apparatus 10 is not limited to a configuration provided with two sticking stations. The sticking apparatus 10 may be provided with only one sticking station, or three or more sticking stations. When the sticking apparatus 10 is provided with three or more sticking stations, the lid body 58 may be shared not only by two sticking stations, but also by three sticking stations.

In addition to the above-described configuration, in the sticking apparatus 10, since the first and second main sticking units 20, 24 are adjacent to each other, the distance by which the lid body 58 is moved by the lid body driving section 100 is shortened, and thus it is possible to reduce the workload of the apparatus for performing the sticking operation and also reduce an operation space. Moreover, by making the operations of the first and second sticking stations 12, 14 different from each other, it is possible to perform the sticking operation in alternate shifts and thereby further improve mass-production efficiency. Furthermore, in the first and second temporary sticking units 18, 22, by pressing the sticking film 28 by a pressing apparatus, the decorative sheet S is stuck on the sticking film 28 more reliably. As a result, in the first and second main sticking units 20, 24, it is possible to stably stick the decorative sheet S on the cowl C with a high degree of accuracy.

Moreover, in the sticking apparatus 10 and the sticking method according to the present embodiment, the restriction plate 84 is disposed in a location which is close to or in contact with the cowl C positioned in the container 56. As a result, when the sticking film 28 is elastically deformed toward the lower space 62, it is possible to prevent the sticking film 28 from being greatly stretched around the cowl C. Therefore, performance degradation of the sticking film 28 caused by the elastic deformation is suppressed, and in the sticking operation, the sticking film 28 of the sticking apparatus 10 can be used for a longer period of time, and thus it is possible to reduce the production cost greatly. Moreover, since the restriction plate 84 has the small holes 84*b*, it is possible to easily flow the air above the restriction plate 84 downward when the pressure in the lower space 62 is reduced. This makes it possible to reduce the pressure inside the lower space 62 evenly and thereby stick the decorative sheet S on the cowl C with stability and a high degree of accuracy when the sticking film 28 is elastically deformed.

In this case, since the receiving surface 85 of the restriction plate 84 is parallel to the direction of a surface of the sticking film 28, it is possible to restrict the elastic deformation of the sticking film 28 by bringing the sticking film 28 into contact with the receiving surface 85 over a wide area when the sticking film 28 is elastically deformed. Furthermore, since the receiving surface 85 is disposed above an intermediate part of the container 56 in a height direction thereof, the deformation amount of the sticking film 28 can be further reduced when the sticking film 28 is elastically deformed. In addition, since the sticking apparatus 10 has the cushion 86 on the peripheral part of the container 56, it is also possible to suppress stretch of the peripheral part of the sticking film 28 effectively. As a result, performance degradation of the sticking film 28 can be further suppressed.

Furthermore, in the sticking apparatus 10 and the sticking method according to the present embodiment, it is possible to suction the air concurrently from the lower space 62 and the upper space 64 by the suction mechanism 128 connected to the pipe 92*h* of the gas flow circuit 126. At this time, the valve 90*j* regulates the flow rate of the air in the pipe 92*g*, whereby the lower space 62 and the upper space 64, which have different volumes, are depressurized while maintaining equal pressures inside the lower space 62 and the upper space 64. As a result, the elastic deformation of the sticking film 28 caused by a pressure difference between the lower space 62 and the upper space 64 is suppressed, and when the sticking film 28 is subsequently elastically deformed by opening the upper space 64 to the atmosphere, it is possible to stick the decorative sheet S on the cowl C satisfactorily. In addition, since the sticking apparatus 10 uses one suction mechanism 128 for suctioning air from both the container 56 and the lid body 58, the apparatus itself is made inexpensive and the production cost can be reduced.

In this case, since the branched pipes 92*a* and 92*b* are connected to the respective containers 56 of the first and second main sticking units 20 and 24 in the gas flow circuit 126, it is possible to selectively depressurize the two containers 56 by one suction mechanism 128, and thus it is possible to further reduce the production cost.

In the above description, the present invention has been described with reference to the preferred embodiment. However, the present invention is not limited to the embodiment described above, and it goes without saying that various changes and modifications can be made thereto within the scope of the present invention. For example, after the pressure reduction, air may be introduced into the lower space 62 and the upper space 64 not only by opening the lower space 62 and the upper space 64 to the atmosphere, but also by actively supplying air thereto by a pump or the like.

The invention claimed is:

1. A sticking apparatus configured to stick a decorative material, which is attached to a sticking film, on an object housed in a container by changing a pressure inside a first space defined by the container and the sticking film and a pressure inside a second space defined by a lid body and the sticking film and thereby elastically deforming the sticking film, wherein the container contains therein:

a jig configured to position the object; and a restricting section disposed in a location that is close to or in contact with the object positioned by the jig, the restricting section having a receiving surface configured to restrict elastic deformation of the sticking film by making contact with the sticking film, wherein at least part of the object is exposed so as to face the sticking film through the receiving surface, and the receiving surface is provided with a hole portion configured to allow air in the first space to flow therethrough.

2. The sticking apparatus according to claim 1, wherein the receiving surface is formed so as to be in parallel to a direction of a surface of the sticking film in a normal state in which the sticking film is not elastically deformed.

3. The sticking apparatus according to claim 1, wherein the receiving surface is placed above an intermediate part of the container in a height direction thereof.

4. The sticking apparatus according to claim 1, wherein the restricting section includes, near a peripheral part of the container, a shock-absorbing section protruding toward the sticking film from the receiving surface, and the sticking film is contactable with the shock-absorbing section.

5. A sticking apparatus configured to stick a decorative material, which is attached to a sticking film, on an object housed in a container by changing a pressure inside a first space defined by the container and the sticking film and a pressure inside a second space defined by a lid body and the sticking film and thereby elastically deforming the sticking film, the sticking apparatus comprising:

a gas flow circuit that includes a first flow channel communicating with the first space, a second flow channel communicating with the second space, and a converging flow channel into which the first and second flow channels converge;

a suction mechanism connected to the converging flow channel and configured to suction gas from the gas flow circuit;

a first measuring unit configured to measure the pressure inside the first space;

a second measuring unit configured to measure the pressure inside the second space; and a flow rate regulating unit provided in the second flow channel and configured to regulate a flow rate of the gas in the second flow channel based on the measured pressure inside the first space and the measured pressure inside the second space.

6. The sticking apparatus according to claim 5, wherein the sticking apparatus includes a plurality of sticking stations, each including the container, and the first flow channel branches off and is connected to each of the containers of the plurality of sticking stations, the first flow channel being configured to selectively communicate with one of the containers.

7. The sticking apparatus according to claim 6, wherein the plurality of sticking stations share the lid body, the second flow channel includes a coupling mechanism at an intermediate position between the flow rate regulating unit and the second space, and the coupling mechanism includes a movable-side terminal configured to move integrally with the lid body, and a fixed-side terminal provided on each of the plurality of sticking stations and configured to be detachably coupled to the movable-side terminal so that the second flow channel is placed in a communication state.

8. A sticking apparatus configured to stick a decorative material on an object, the sticking apparatus comprising:

a first sticking unit configured to place a sticking tool having a sticking film and stick the decorative material on the sticking film in a state in which a sticking surface of the decorative material is exposed; and a second sticking unit provided in a location different from a location of the first sticking unit, and including a container configured to house the object and a lid body configured to be detachably attached to the container with the sticking film, on which the decorative material was stuck in the first sticking unit, being sandwiched between the container and the lid body, the second sticking unit being configured to stick the decorative material on the object by changing a pressure inside a first space defined by the container and the sticking film and a pressure inside a second space defined by the lid body and the sticking film and thereby elastically deforming the sticking film.

9. The sticking apparatus according to claim 8, wherein the sticking apparatus includes a plurality of sticking stations, each including the first sticking unit and the second sticking unit excluding the lid body, and the lid body is shared by the plurality of sticking stations.

10. The sticking apparatus according to claim 9, wherein the sticking apparatus includes a suction mechanism configured to impart a suction force to the first space and the second space, and the suction mechanism is shared by the plurality of sticking stations.

11. The sticking apparatus according to claim 9, wherein in two sticking stations of the plurality of sticking stations, the second sticking units are adjacent to each other, and the lid body is moved between the second sticking units of the two sticking stations by a lid body driving unit.

12. The sticking apparatus according to claim 11, wherein when the first sticking unit in one of the two sticking stations performs an operation to stick the decorative material on the sticking film, the second sticking unit in another one of the two sticking stations performs an operation to stick the decorative material on the object, and when the second sticking unit in the one of the two sticking stations performs an operation to stick the decorative material on the object, the first sticking unit in the other one of the two sticking stations performs an operation to stick the decorative material on the sticking film.

13. A sticking method of sticking a decorative material, which is attached to a sticking film, on an object housed in a container by changing a pressure inside a first space defined by the container and the sticking film and a pressure inside a second space defined by a lid body and the sticking film and thereby elastically deforming the sticking film, the sticking method comprising:

a first step of positioning the object on a jig provided in the container and exposing at least part of the object through a receiving surface of a restricting section so as to face the sticking film, the restricting section being disposed in a location that is close to or in contact with the object;

a second step of, after the first step, depressurizing the first and second spaces and at this time, causing air in the first space to flow through a hole portion formed in the receiving surface; and a third step of, after the second step, sticking the decorative material on the object by introducing air into the second space to thereby elastically deforming the sticking film toward the object, while causing air to flow through the hole portion from a side of the first space closer to the sticking film toward another side thereof across the receiving surface from the sticking film, and restricting elastic deformation of the sticking film around the object by the receiving surface.

14. A sticking method of sticking a decorative material, which is attached to a sticking film, on an object housed in a container by changing a pressure inside a first space defined by the container and the sticking film and a pressure inside a second space defined by a lid body and the sticking film and thereby elastically deforming the sticking film, the sticking method comprising the steps of:

suctioning gas in a gas flow circuit by a suction mechanism, the gas flow circuit including a first flow channel communicating with the first space, a second flow channel communicating with the second space, and a converging flow channel into which the first and second flow channels converge, the suction mechanism being connected to the converging flow channel;

measuring the pressure inside the first space by a first measuring unit;

measuring the pressure inside the second space by a second measuring unit; and regulating a flow rate of the gas by a flow rate regulating unit provided in the second flow channel based on the measured pressure inside the first space and the measured pressure inside the second space.

15. A sticking method of a sticking apparatus configured to stick a decorative material on an object, the sticking method comprising:

a first sticking step of placing a sticking tool having a sticking film in a first sticking unit and sticking the decorative material on the sticking film in a state in which a sticking surface of the decorative material is exposed; and a second sticking step of sticking the decorative material on the object by changing a pressure inside a first space defined by a container and the sticking film and a pressure inside a second space defined by a lid body and the sticking film to thereby elastically deform the sticking film in a second sticking unit provided in a location different from a location of the first sticking unit, the second sticking unit including the container configured to house the object, and the lid body configured to be detachably attached to the container with the sticking film, on which the decorative material was stuck in the first sticking step, being sandwiched between the container and the lid body.

16. The sticking method according to claim 15, wherein the sticking apparatus includes a plurality of sticking stations configured to perform the first sticking step and the second sticking step, and in the second sticking step, the plurality of sticking stations share the lid body.

17. The sticking method according to claim 16, wherein the sticking apparatus includes a suction mechanism configured to impart a suction force to the first space and the second space, and in the second sticking step, the plurality of sticking stations share the suction mechanism.

18. The sticking method according to claim 16, wherein in two sticking stations of the plurality of sticking stations, the second sticking units are adjacent to each other, and before the second sticking step is performed, a movement step of moving the lid body between the second sticking units of the two sticking stations by a lid body driving unit is performed.

19. The sticking method according to claim 18, wherein when one of the two sticking stations performs the first sticking step, another one of the two sticking stations performs the second sticking step, and when the one of the two sticking stations performs the second sticking step, the other one of the two sticking stations performs the first sticking step.

* * * * *